United States Patent [19]

Negoro et al.

[11] Patent Number: 4,924,266

[45] Date of Patent: May 8, 1990

[54] PRINTER FOR CONTINUOUS FORM

[75] Inventors: Ikuo Negoro, Sakado; Masahiro Kita, Tokyo, both of Japan

[73] Assignee: Asahi Kogaku Kogyo K.K., Tokyo, Japan

[21] Appl. No.: 195,298

[22] Filed: May 18, 1988

[30] Foreign Application Priority Data

| | | | |
|---|---|---|---|
| May 19, 1987 | [JP] | Japan | 62-74830[U] |
| Jun. 12, 1987 | [JP] | Japan | 62-90385[U] |
| Jul. 7, 1987 | [JP] | Japan | 62-169341 |
| Aug. 20, 1987 | [JP] | Japan | 62-206666 |

[51] Int. Cl.[5] ..... G03G 15/00

[52] U.S. Cl. ..... 355/205; 355/308; 226/10; 226/27; 340/675

[58] Field of Search ..... 355/3 SH, 14 SH, 14 R, 355/206, 309, 316, 317, 205; 226/10, 11, 24, 25, 27, 28; 340/675; 400/579; 250/561, 571; 346/160; 377/18, 53

[56] References Cited

U.S. PATENT DOCUMENTS

| | | | |
|---|---|---|---|
| 3,659,081 | 4/1972 | Piccione | 340/675 X |
| 3,779,440 | 12/1973 | Casale et al. | 340/675 X |
| 3,949,856 | 4/1976 | Ulber et al. | 340/675 X |
| 4,588,884 | 5/1986 | Priscott | 340/675 X |
| 4,641,070 | 2/1987 | Pfizenmaier et al. | 250/561 X |
| 4,731,542 | 3/1988 | Doggett | 250/571 X |

FOREIGN PATENT DOCUMENTS

| | | | |
|---|---|---|---|
| 57-19248 | 2/1982 | Japan | 226/10 |
| 60-58517 | 4/1985 | Japan | 340/675 |
| 60-137752 | 7/1985 | Japan . | |

*Primary Examiner*—Joan H. Pendegrass
*Attorney, Agent, or Firm*—Sandler & Greenblum

[57] ABSTRACT

In a printer for printing information onto a continuous form, at least one of opposite side edges of the continuous form is detected by a side-edge detecting arrangement. It is judged that a traveling abnormality of the continuous form occurs, when a detecting signal representative of the at least one side edge of the continuous form detected by the side-edge detecting arrangement continues for a preset period of time and more. If the continuous form is provided therein with sprocket holes, the side-edge detecting arrangement may include a pair of side-edge detectors each for detecting the sprocket holes in a corresponding one of opposite side edge portions of the continuous form. In this case, it is judged that the traveling abnormality of the continuous form occurs, when the detecting signal representative of the sprocket holes in each side edge portion of the continuous form is not continuously outputted within a preset period of time and more.

20 Claims, 20 Drawing Sheets

BEST AVAILABLE COPY

AT NORMAL TRAVELING

AT LEFTWARD SKEWING

AT RIGHTWARD SKEWING

PRINTER FOR CONTINUOUS FORM

BACKGROUND OF THE INVENTION

This invention relates to a printer employing a continuous form and, more particularly, to a detecting device for detecting traveling abnormalities such as skewing, meandering and the like of the continuous form.

Conventionally, there is known an image recording device utilizing a so-called electrophotographic system in which a surface of a photoconductive drum is exposed to light to form a latent image on the drum surface, toner is then applied to the latent image to develop the image, and the developed image is transferred onto a recording sheet material and is fixed by a fixing unit. Such image recording device is chiefly employed in a copying machine. In recent years, however, the image recording device is utilized in a printer and the like for printing out output from a computer.

In the copying machine, in general, cut sheets are used as the recording sheet material, and a heat-roll fixing system is utilized wherein the toner is fixed by heat as well as pressure. In addition, a pressure fixing system has recently been developed, which is low in electric power consumption and which does not require an amount of time for preheating the heat rolls.

In the printer, however, it is desired to use, as the recording material, a continuous recording form identical with that used in a conventional line-printer. The continuous recording form identical with the conventional one is a folded continuous recording form (hereinafter referred to simply as "continuous form") called a fan-folded form which has formed therein sprocket holes. Perforation is provided at each of the folded sections to enable sheet sections to easily be severed from each other.

When the above fixing systems are applied to the continuous form, the following problem might arise. That is, the continuous form clamped between the fixing rolls would skew or meander because of various factors such as poor initial biting of the continuous form into the nip between the fixing rolls, unevenness or nonuniformity in thickness of the continuous form, elongation of the continuous form due to absorption of moisture, and the like. If such skewing or meandering occurs, the biting position of the continuous form with respect to the fixing rolls consecutively varies laterally, so that the side edge of the continuous form finally reaches the lateral end of the nip between the fixing rolls. This causes creases in the continuous form, resulting in defective fixing of the image and in traveling troubles of the continuous form. In view of such problems, an arrangement has been proposed in which a tension-applying mechanism is provided for applying a tension to a portion of the continuous form extending between the photoconductive drum and the fixing roll pair, to uniformize the state of the continuous form to be bitten into the nip between the pair of fixing rolls. By this tension-applying mechanism, it is made possible to prevent meandering or skewing of the continuous form, and to automatically restore the continuous form to the regular position even if such meandering or skewing occurs.

However, traveling troubles incapable of being restored sometimes occur due to factors such as forces applied to the continuous form from the outside, excessive elongation and shrinkage of the continuous form, a malfunction of the transport system, severance of the continuous form, and the like.

If the continuous form continues to travel while occurrence of the above troubles is maintained, the continuous form is bitten into the transport system and the drive system. This results in jamming of the continuous form so that a load is applied to the device. Thus, there arises a serious problem that, in the worst case, the above troubles result in malfunction or destruction of the device. Therefore, it is necessary to immediately halt operation of the device. However, manual operation is slow in response and cannot adequately deal with the troubles.

SUMMARY OF THE INVENTION

It is therefore an object of this invention to provide an improved printer comprising a traveling-trouble detecting arrangement capable of generating an error signal indicative of occurrence of skewing or meandering of a continuous form, which is incapable of being restored.

For the above purpose, according to the invention, there is provided a printer for printing information onto a continuous form, which comprises side-edge detecting means arranged adjacent at least one of opposite side edges of the continuous form being transported, for detecting the side edge of the continuous form, and traveling-trouble detecting means for judging that a traveling abnormality of the continuous form occurs, when a detecting signal representative of the side edge of the continuous form detected by the side-edge detecting means continues for a preset period of time and more, to output an error signal, wherein the abnormal traveling state of the continuous form is detected on the basis of presence and absence of the error signal. Utilization of the error signal makes it possible to interrupt transportation of the continuous form.

If a continuous form is employed which has sprocket holes provided along each of opposite side edges of the continuous form, a printer according to the invention comprises sprocket-hole detecting means for detecting the sprocket holes in at least one of opposite side edge portions of the continuous form being transported, and traveling-trouble detecting means for judging that a traveling abnormality of the continuous form provided therein with the sprocket holes occurs, when a detecting signal representative of the sprocket holes detected by the sprocket-hole detecting means is not outputted continuously for a preset period of time, to output an error signal, wherein the abnormal traveling state is detected on the basis of presence and absence of the error signal.

It is another object of this invention to provide an improved printer comprising a traveling-trouble detecting arrangement capable of generating a pair of error signals each indicative of occurrence of skewing or meandering of a corresponding one of opposite side edges of a continuous form, the skewing or meandering being incapable of being restored.

For the above purpose, according to this invention, there is further provided a printer for printing information onto a continuous form having sprocket holes provided along each of opposite side edges of the continuous form, which comprises a pair of sprocket-hole detecting means, each of the sprocket-hole detecting means outputting a detecting signal each time the sprocket-hole detecting means successively detects the sprocket holes provided in a corresponding one of opposite side edge portions of the fan-folded form being transported, and traveling-trouble detecting means for judging whether or not the detecting signals from each of the sprocket-hole detecting means are outputted at timing in compliance with an interval between each pair of adjacent sprocket holes in a corresponding one of the opposite side edge portions of the fan-folded form, the traveling-trouble detecting means judging that a traveling abnormality of the continuous form provided with the sprocket holes occurs, when the detecting signals from the sprocket-hole detecting means are not outputted at the timing in compliance with the interval between each pair of adjacent sprocket holes, to generate a pair of error signals for the respective side edges of the continuous form, wherein the abnormal traveling state is detected on the basis of presence and absence of the error signals.

Utilization of the pair of error signals makes it possible to interrupt transportation of the continuous form when the traveling abnormality of the continuous form occurs which is incapable of being restored. Utilization of the pair of error signals also makes it possible to display that the traveling abnormality occurs on one or the other of the opposite side edges of the continuous form or both side edges thereof, if a pair of error indicator lamps are provided correspondingly respectively to the pair of error signals.

Moreover, if the pair of error signals are totalized respectively, the totalized values indicate skewing careers or histories of the respective side edges of the continuous form. Accordingly, the totalized values can be utilized to adjust fixing pressures applied respectively to the opposite side edges of the continuous form at a fixing station.

Furthermore, for the above purpose, there is also provided a printer for printing information onto a continuous form, which comprises a pair of first and second signal generating means for continuously generating their respective pulse signals in synchronism with transport velocities of respective opposite side edges of the continuous form being transported, and traveling-trouble detecting means for judging that a traveling abnormality of the continuous form occurs, when one of lead and lag of in phase of the pulse signals from one of the first and second signal generating means on the basis of the pulse signals from the other signal generating means continues for a preset period of time and more, after expiration of a set period of time within a pulse duration of each of the pulse signals from the first and second signal generating means, from rise of either ones, which rise first, of the pulse signals from the first signal generating means and the pulse signals from the second pulse generating means, in a period of time within the pulse duration, to produce a pair of error signals representative of respective lead and lag of phase of the pulse signals from the one signal generating means on the basis of the pulse signals from the other signal generating means.

According to the invention, there is also provided a printer for printing information onto a continuous form, which comprises a line sensor arranged to cross over the continuous form being transported, for detecting opposite side edges of the continuous form, and traveling-trouble detecting means for judging that a traveling abnormality of the continuous form occurs, based upon a detecting signal representative of the side edges of the continuous form detected by the line sensor.

According to the invention, there is further provided a printer for printing information onto a continuous form having sprocket holes provided along each of opposite side edges of the continuous form, which comprises a line sensor arranged to cross over the continuous form having transported, for detecting the sprocket holes and opposite side edges of the continuous form, and traveling-trouble detecting means for judging that a traveling abnormality of the continuous form provided therein with the sprocket holes occurs based upon a detecting signal representative of the sprocket holes and the side edges detected by the line sensor, the traveling-trouble detecting means comprising:

first discriminating means for judging occurrence of skewing by monitoring the distance between the side edges detected by the line sensor, the discriminating means outputting a first error signal in case the detected distance differs from a normal value for a present period of time and more;

second discriminating means for judging occurrence of jamming by monitoring the distance between the side edges detected by the line sensor, the discriminating means outputting a second error signal in case the detected distance exceeds a predetermined value; and third discriminating means for judging occurrence of severing of the continuous form by monitoring a configuration of an output signal of the line sensor, the third discriminating means outputting a third error signal in case the configuration coincides with on of predetermined patterns.

BRIEF DESCRIPTION OF THE ACCOMPANYING DRAWINGS

Figure 2:
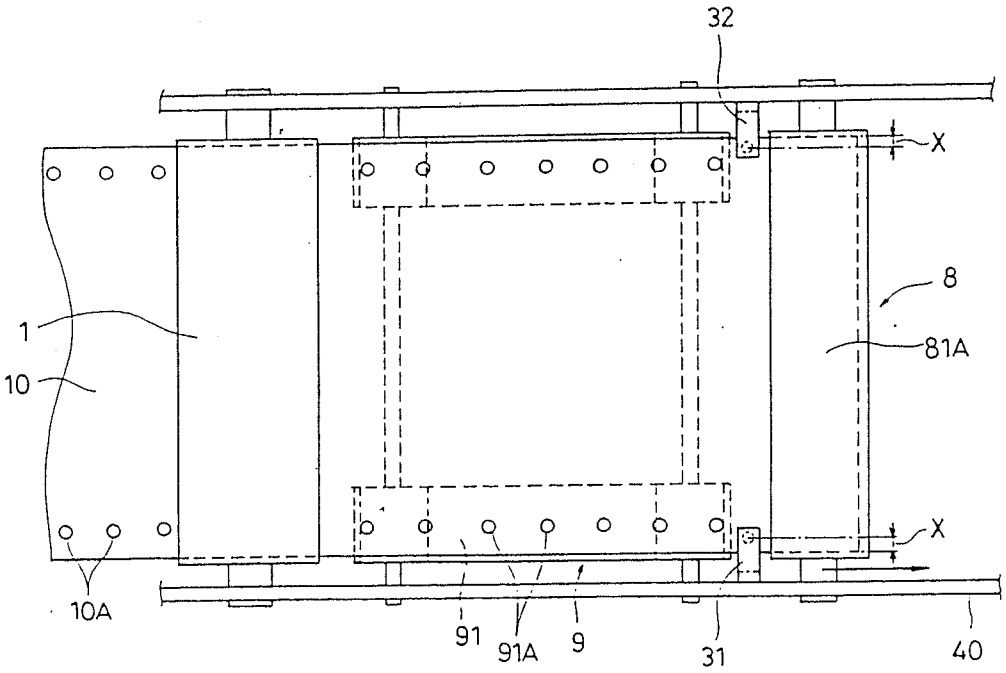
FIG. 2 is a fragmental plan view of the printer illustrated in FIG. 1, showing the arrangement of the traveling-trouble detecting device.
Figure 5:
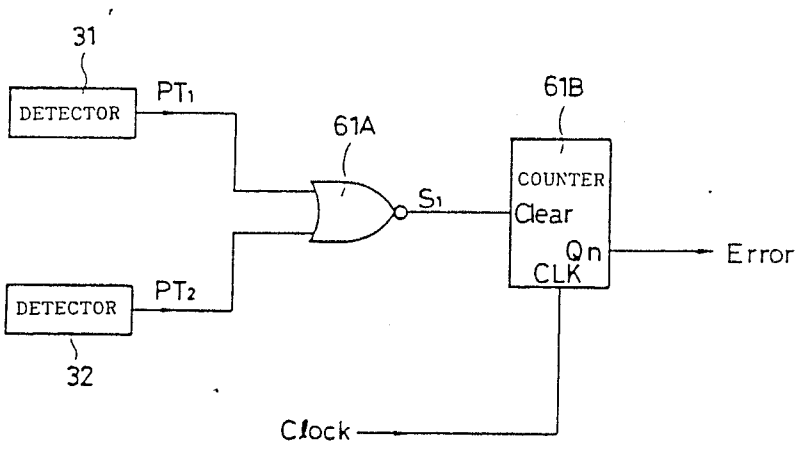
Figure 6:
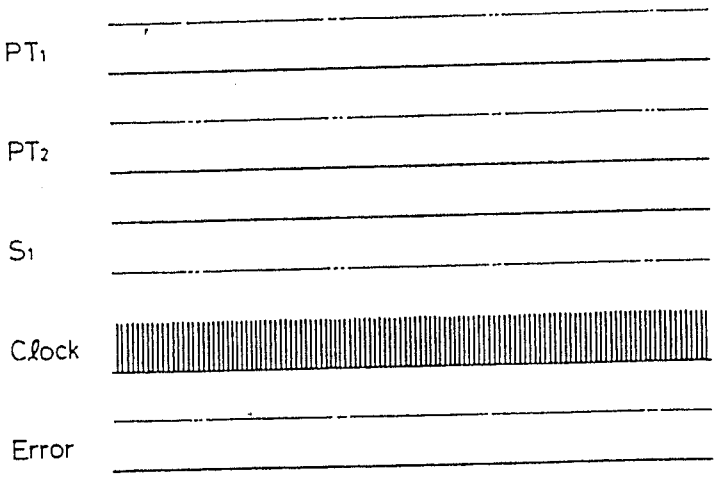
Figure 7:
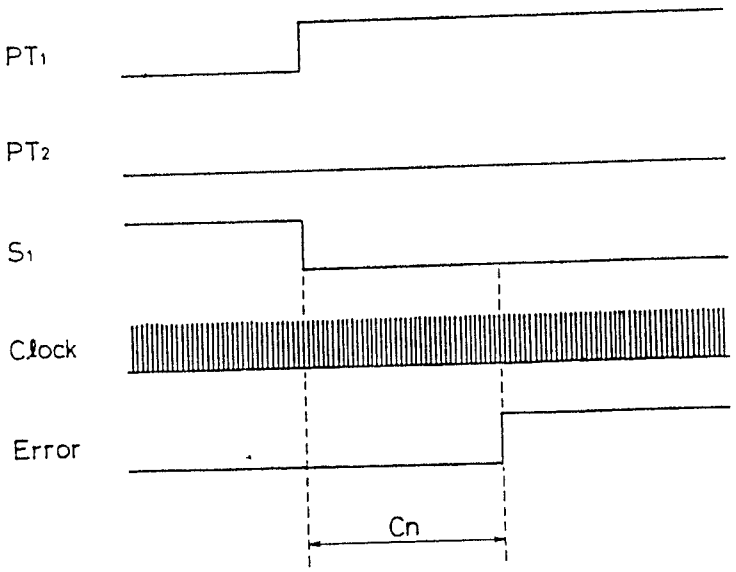
Figure 8:
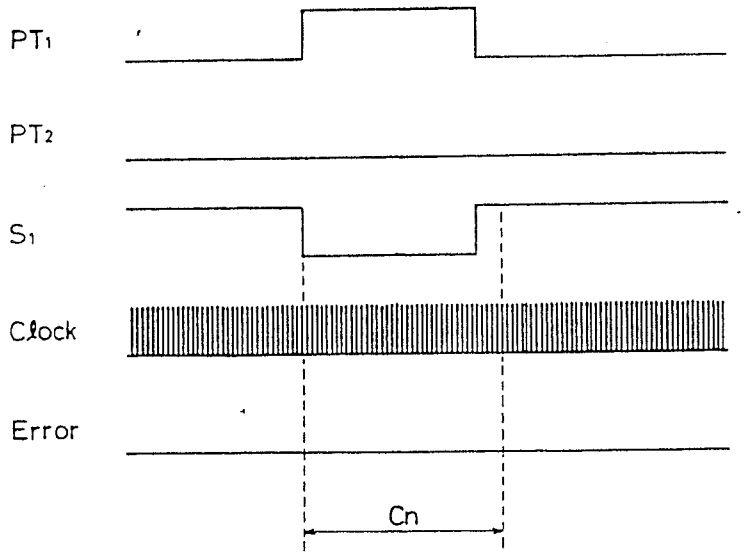
Figure 9:
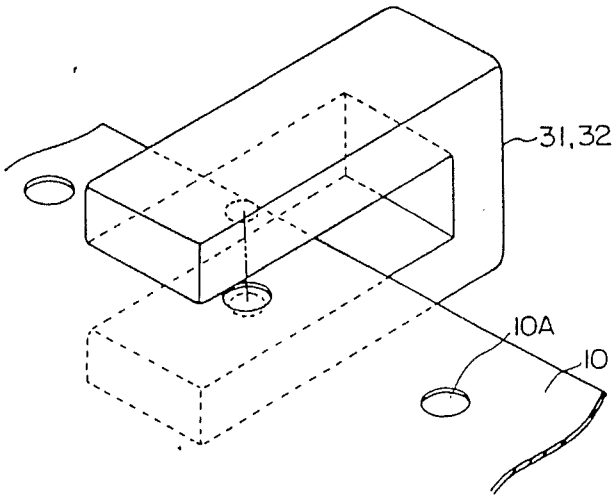
Figure 10:
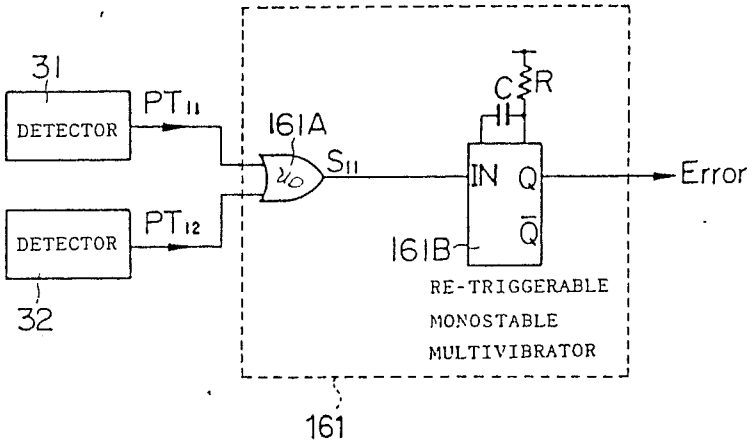
Figure 15:
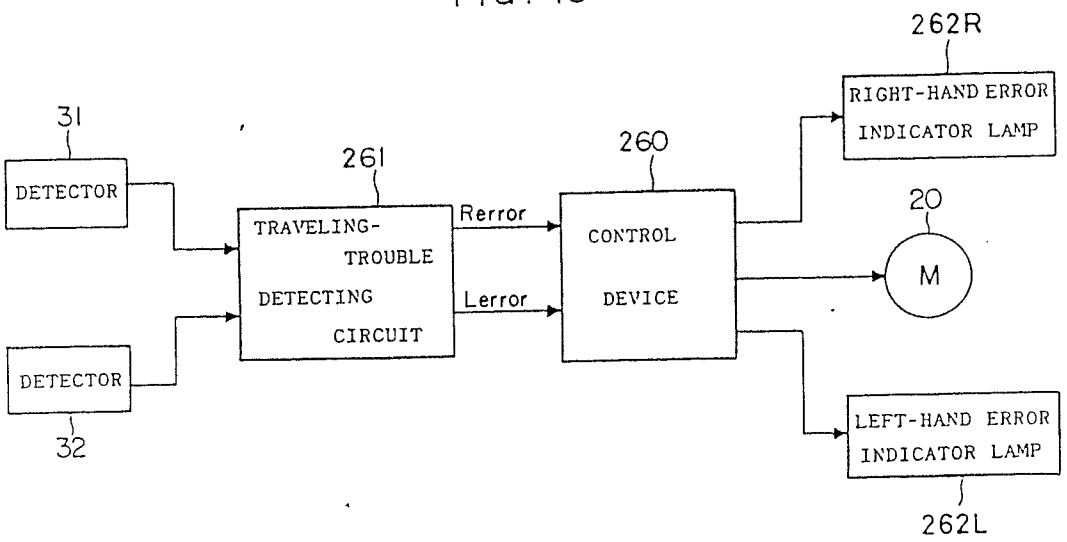
Figure 16:
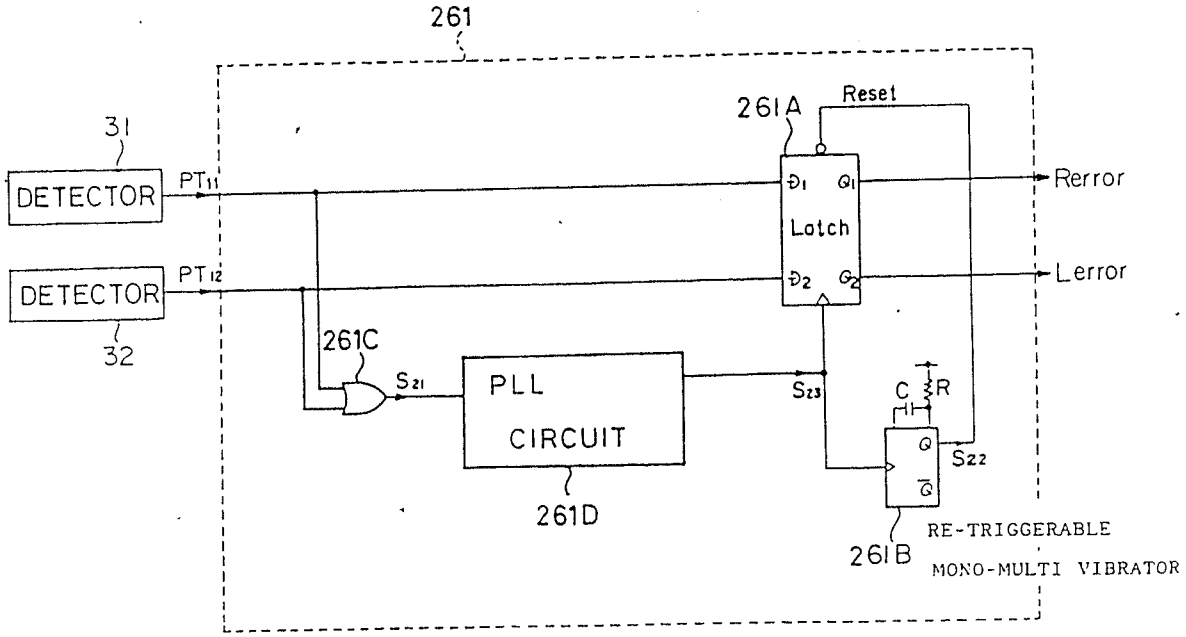
Figure 21:
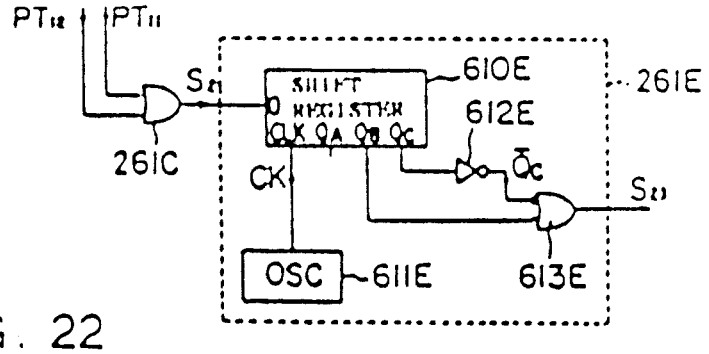
Figure 22:
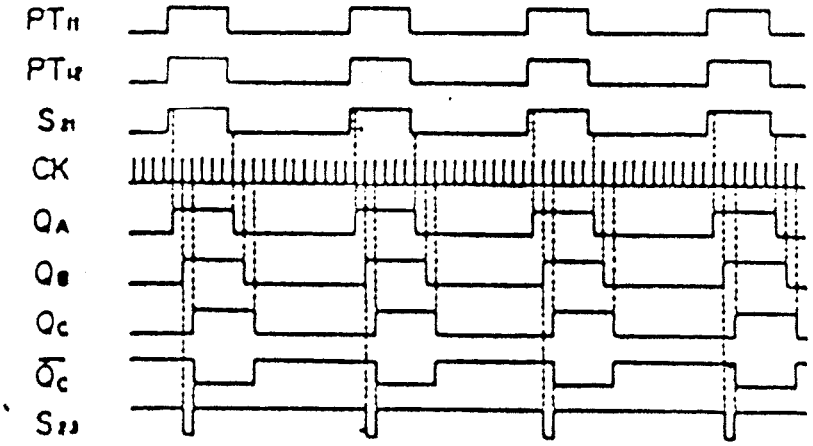
Figure 23:
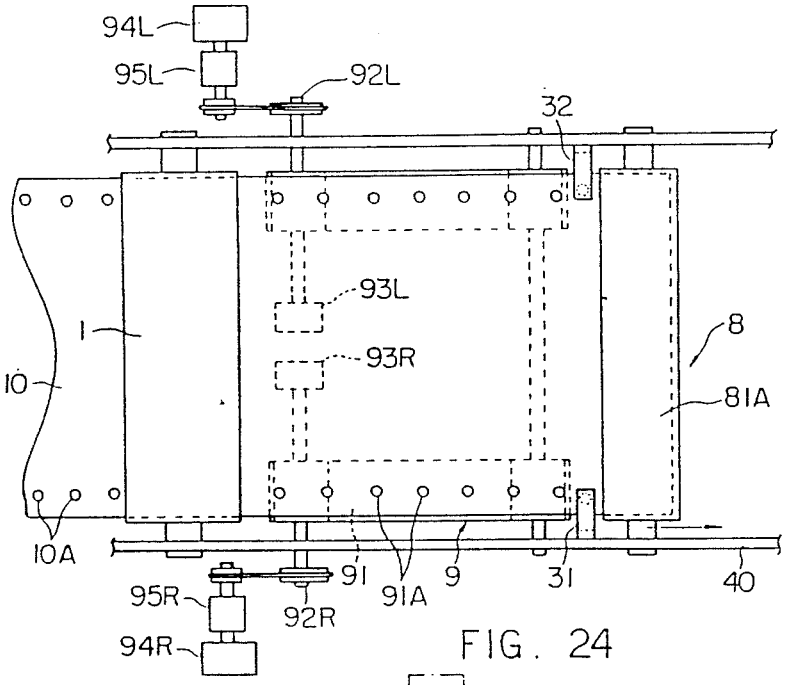
Figure 24:
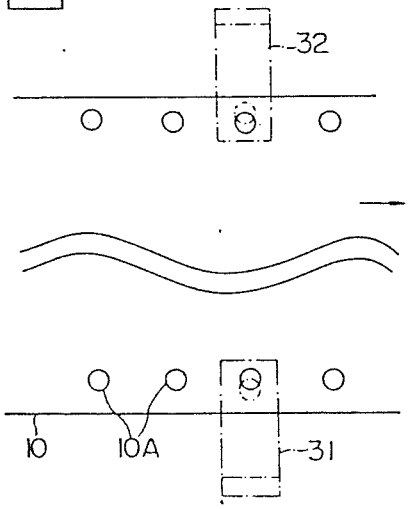
Figure 25:
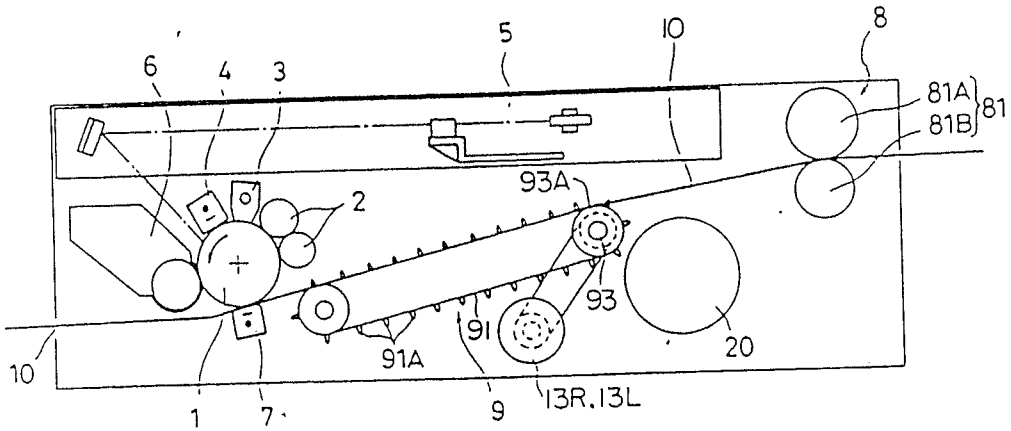
Figure 26:
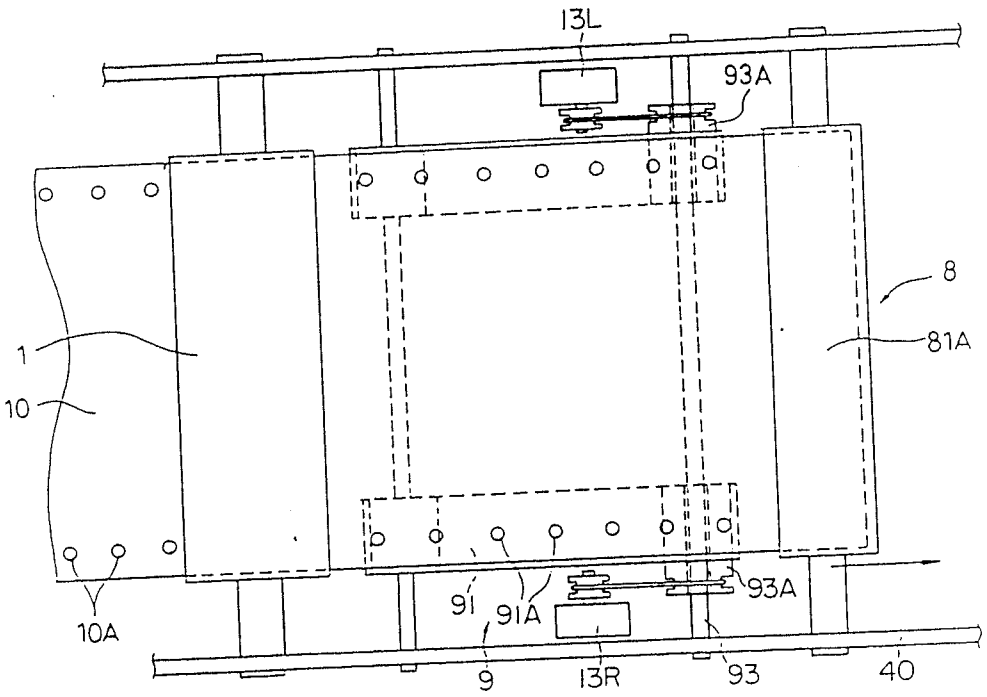
Figure 29:
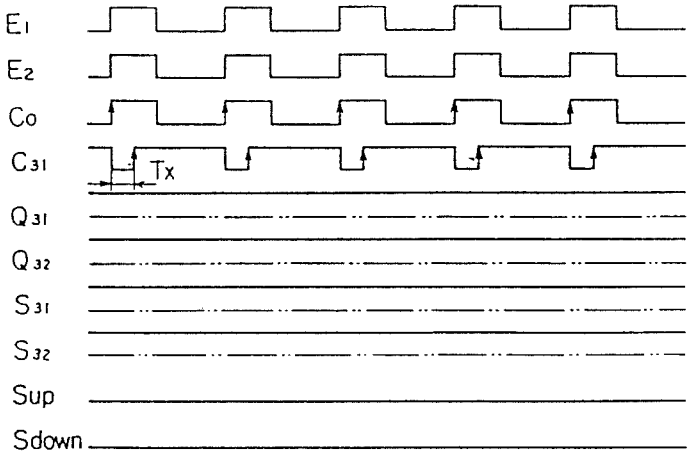
Figure 30:
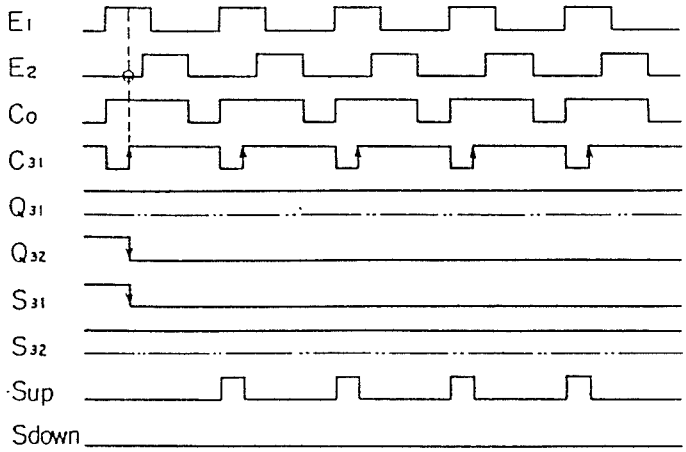
Figure 31:
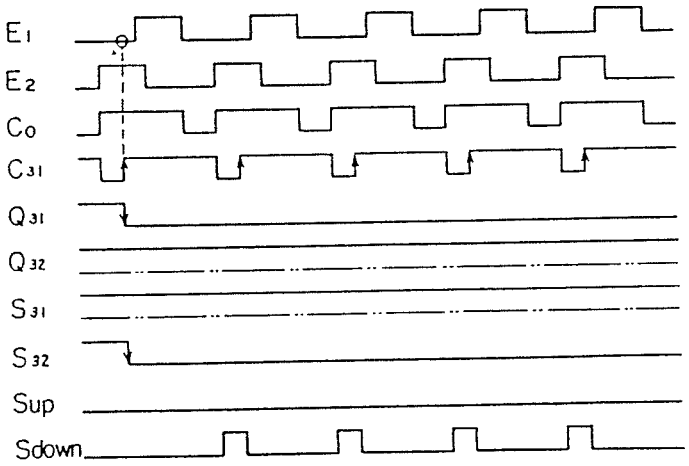
Figure 33:
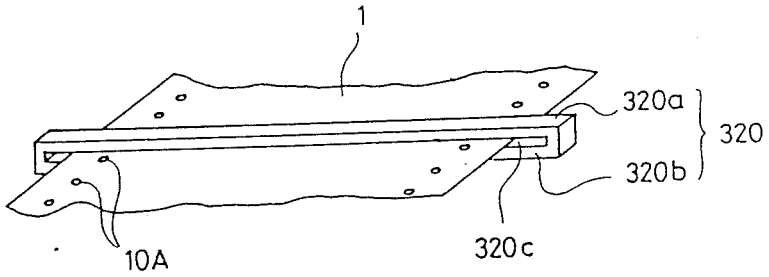
Figure 34:
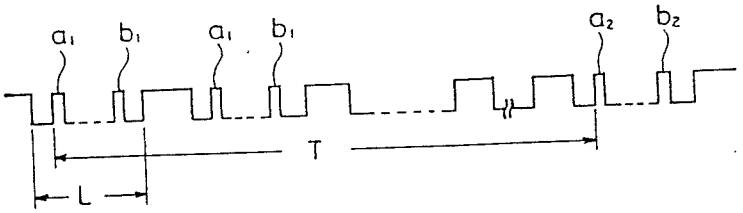
Figure 35:
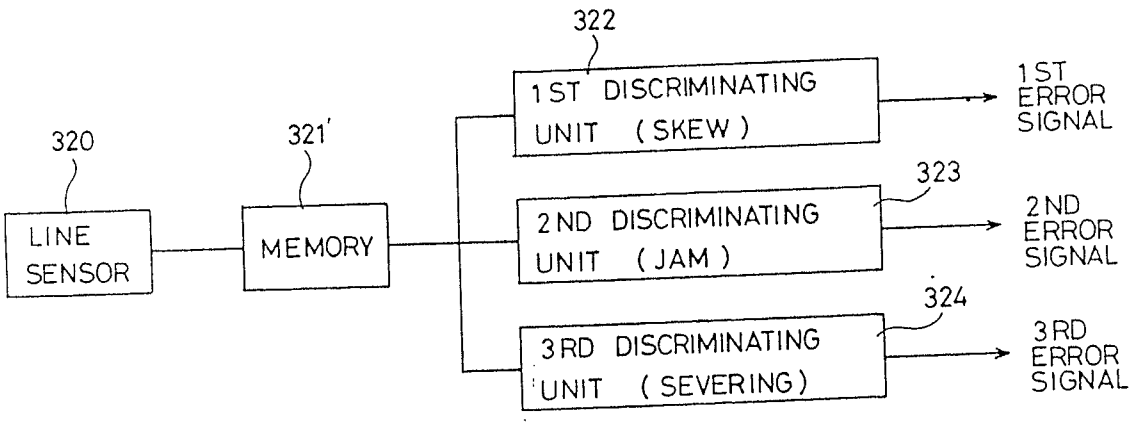
Figure 4:
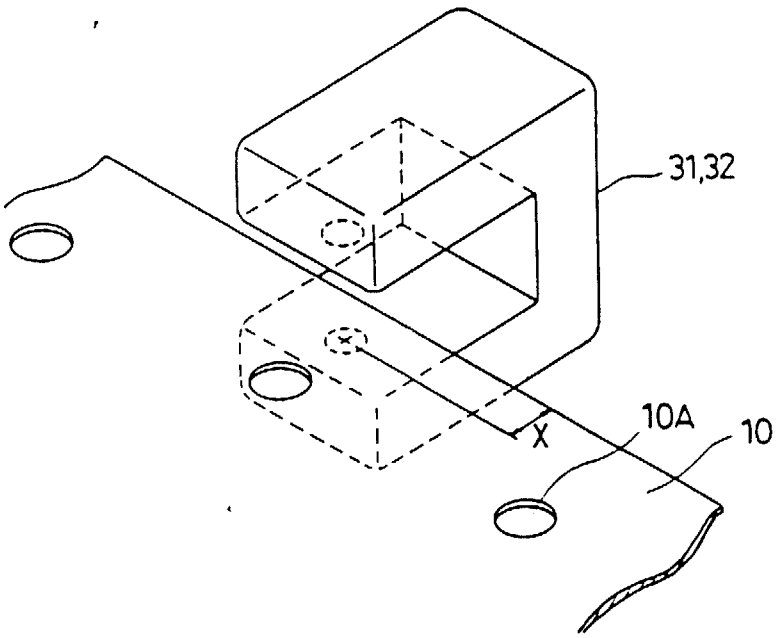
Figure 27:
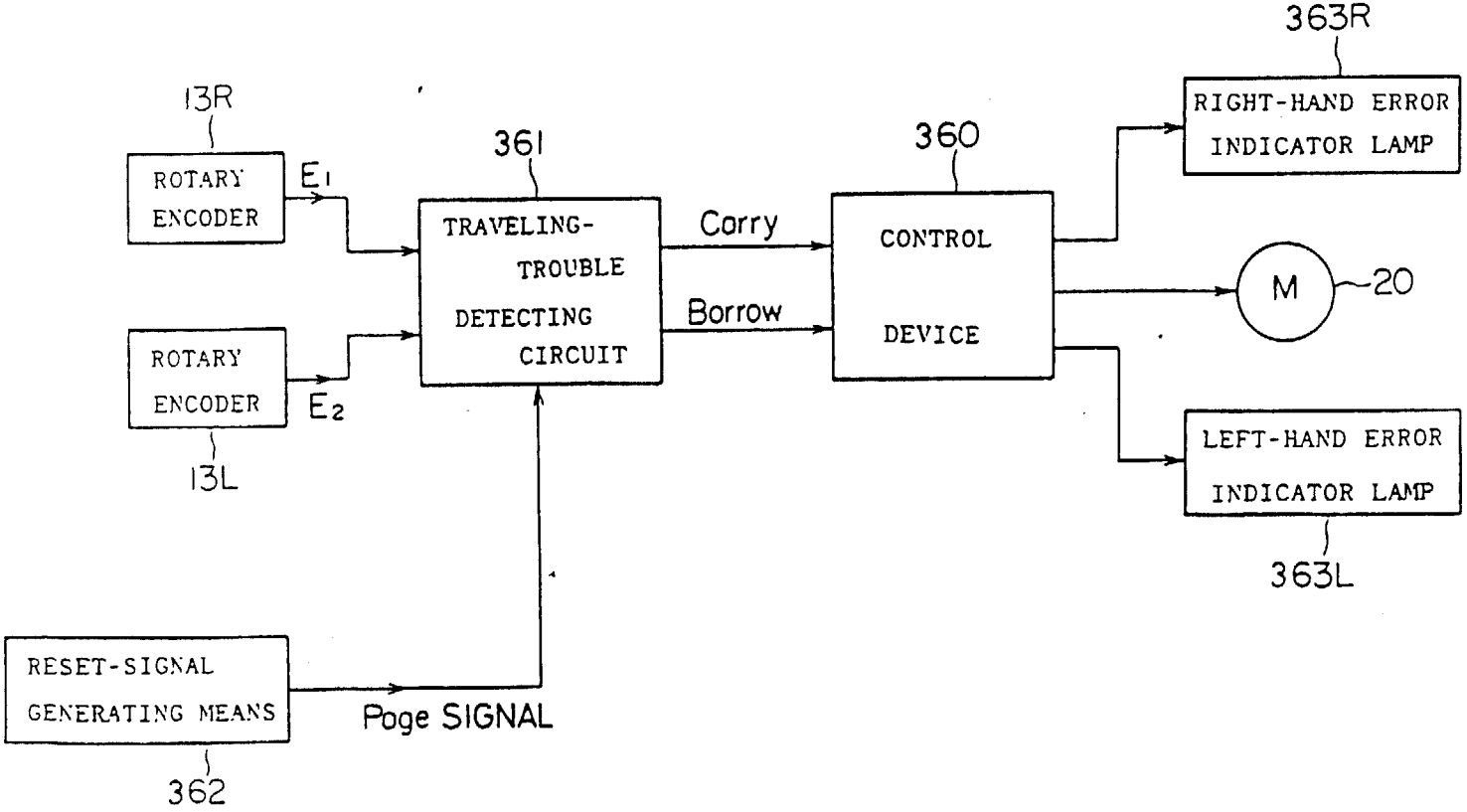
Figure 28:
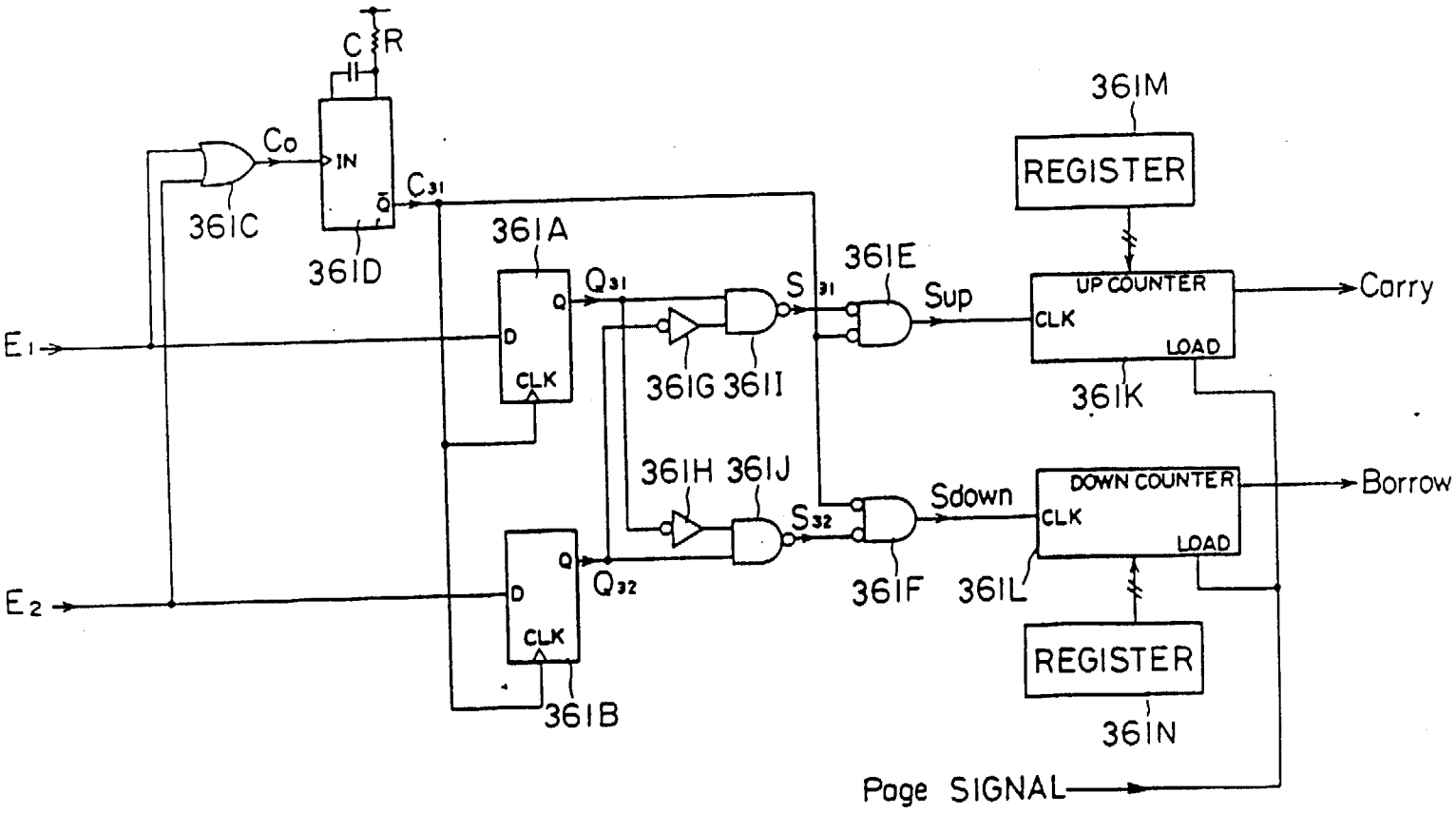
Figure 32:
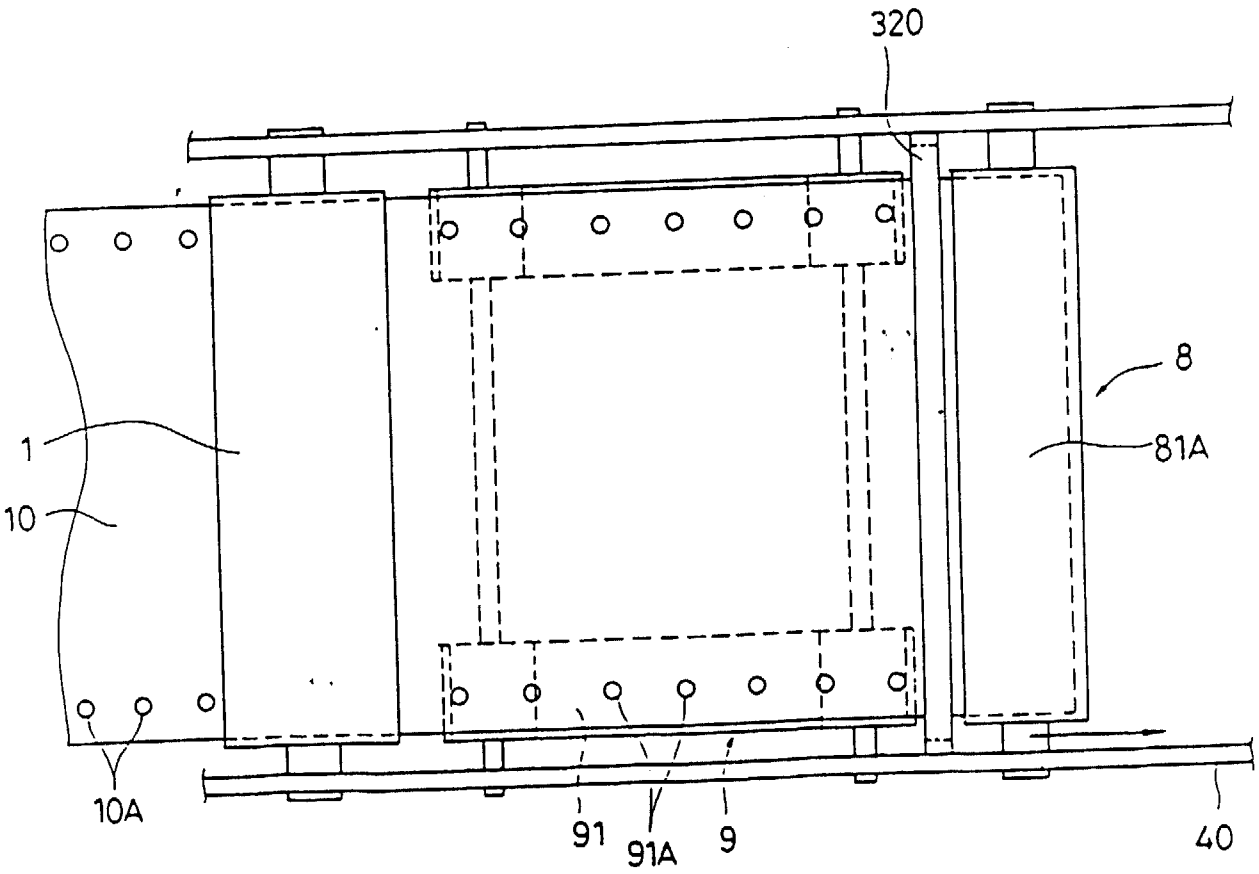

FIG. 4 an enlarged fragmental perspective view of one of a pair of detectors which constitute the traveling-trouble detecting device;

FIG. 5 a circuit diagram of the traveling-trouble detecting device;

FIGS. 6, 7 and 8 are time charts of various signals for explanation of the operation of the traveling-trouble detecting device;

FIG. 9 is a view similar to FIG. 4, but showing one of a pair of detectors which constitute a traveling-trouble detecting device incorporated in a printer according to a modification of the invention;

FIG. 10 is a specific circuit diagram showing an example of the traveling-trouble detecting device illustrated in FIG. 9;

FIGS. 11, 12, 13 and 14 are time charts of various signals for explanation of the operation of the traveling-trouble detecting device illustrated in FIG. 9;

FIG. 15 is a control block diagram of a traveling-travel detecting device incorporated in a printer according to another modification of the invention;

FIG. 16 is a specific circuit diagram of an example of the traveling-trouble detecting device illustrated in FIG. 15;

FIGS. 17, 18, 19 and 20 are time charts of various signals for explanation of the operation of the traveling-trouble detecting device illustrated in FIG. 15;

FIG. 21 is a block diagram of a circuit capable of being replaced by a PLL circuit illustrated in FIG. 16;

FIG. 22 is a time chart of various signals for explanation of the operation of the circuit illustrated in FIG. 21;

FIG. 23 is a fragmental plan view of still another modification of the printer embodying the invention, in which optical paths of lights emitted respectively from the detectors illustrated in FIG. 2 are modified, and the direction-regulating feed mechanism illustrated in FIG. 2 is also modified;

FIG. 24 is an enlarged fragmental view of the detectors and associated sections of the continuous form illustrated in FIG. 23;

FIG. 25 a schematic constructional side elevational view of another modification of the printer embodying the invention, which has incorporated therein a traveling-trouble detecting device different from those described above;

FIG. 26 is a fragmental plan view of a transport system of the printer illustrated in FIG. 25;

FIG. 27 is a control block diagram of the traveling-trouble detecting device illustrated in FIG. 25;

FIG. 28 is a specific block diagram showing an example of a detecting circuit of the detecting device illustrated in FIG. 27;

FIGS. 29, 30 and 31 are flow charts of various signals for explanation of the operation of the traveling-trouble detecting device illustrated in FIG. 27;

FIG. 32 is a fragmental plan view of a transport system of the printer incorporating a still further modified detecting device embodying the invention;

FIG. 33 shows a line sensor employed in the detecting device illustrated in FIG. 32;

FIG. 34 is a sample configuration of an output of the line sensor illustrated in FIG. 33; and FIG. 35 is a block diagram of the detecting device illustrated in FIG. 32.

DESCRIPTION OF THE EMBODIMENTS

An embodiment of the invention and various modifications thereof will be described below with reference to the accompanying drawings.

Figure 1:
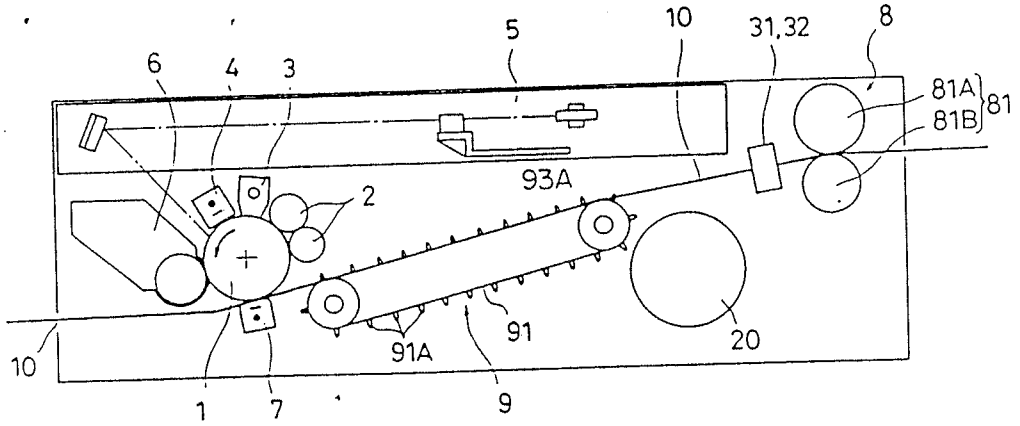
FIG. 1 is a somewhat schematic constructional side elevational view of a printer embodying the invention, which has incorporated therein a traveling-trouble detecting device for a continuous form.

Referring to FIGS. 1 and 2, there is illustrated a laser beam printer embodying the invention, in which a fan-folded form 10 is used as a continuous recording form, and in which an arrangement for detecting traveling troubles of the fan-folded form 10 is incorporated. The laser beam printer is designed to print out information from a computer or the like, onto the fan-folded form 10 by means of an electrophotographic system. As shown in FIG. 2, the fan-folded form 10 has sprocket holes 10A which are formed along each of opposite side edges of the fan-folded form 10 and which are spaced from each other at intervals of ½ inch, for example.

The laser beam printer comprises a photoconductive drum 1. Arranged about the photoconductive drum 1 in due order in a rotational direction thereof indicated by the arrow in FIG. 1 are a toner-cleaning station 2, a de-charging station 3, a charging station 4, an optical scanning system 5 for directing a laser beam modulated on the basis of inputted information, to the photoconductive drum 1, a developing station 6, and a transferring station 7. A fixing station 8 is arranged downstream of the photoconductive drum 1 with reference to the traveling direction in which the fan-folded form 10 travels along a predetermined path. A direction-regulating feed mechanism 9 is arranged in the predetermined path and at a location between the photoconductive drum 1 and the fixing station 8. A pair of detectors 31 and 32 serving respectively as detecting means for detecting the respective side edges of the fan-folded form 10 are arranged in the predetermined path and at a location between the direction-regulating feed mechanism 9 and the fixing station 8.

The arrangement is such that the laser beam from the optical scanning system 5 scans the charged surface of the drum 1 along an axis thereof to carry out a main scanning, and the drum 1 is rotated to carry out an auxiliary scanning, to thereby form a latent image on the charged drum surface. Toner is then applied at the developing station 6 to the latent image to develop the same. Subsequently, the developed toner image is transferred at the transferring station 7 onto the fan-folded form 10 driven to travel by the mechanism of the fixing station 8 at a velocity identical with the peripheral speed of the photoconductive drum 1. The transferred toner image on the fan-folded form 10 is fixed at the fixing station 8. The fan-folded form 10 having carried thereon the fixed image is discharged out of the printer.

At the fixing station 8, a fixing roll pair 81 is arranged which is composed of a pair of upper and lower pressure rolls 81A and 81B having their respective axes extending perpendicularly to the traveling direction of the fan-folded form 10. A gap defined between outer peripheral surfaces of the respective upper and lower pressure rolls 81A and 81B of the fixing roll pair 81 is so set that when the fan-folded form 10 is clamped between both the pressure rolls 81A and 81B, the fan-folded form 10 is pressurized with a predetermined pressure.

The upper pressure roll 81B is drivingly connected to a drive motor 20 through a chain (not shown). The upper pressure roll 81B is rotatively driven by the drive motor 20 to clamp the fan-folded form 10 having carried thereon an unfixed image, between the upper and lower pressure rolls 81B and 81A. The upper and lower pressure rolls 81B and 81A cooperate with each other to pressurize the fan-folded form 10 to squeeze the unfixed image thereon, thereby fixing the image onto the fan-folded form 10. This is called a pressure-fixing system. The upper and lower pressure rolls 81B and 81A also cooperate with each other to drive the fan-folded form 10 to travel along the predetermined path, to discharge the fan-folded form 10 having carried thereon the fixed image, out of the printer.

The peripheral speed of the photoconductive drum 1 is brought completely into coincidence with that of the pressure roll pair 81. That is, the fan-folded form 10 is driven to travel at the transport velocity corresponding to the peripheral speed of the pressure roll pair 81.

Meanwhile, a heat-roll fixing system may of course be adopted in stead of the pressure fixing system in this embodiment.

Figure 3:
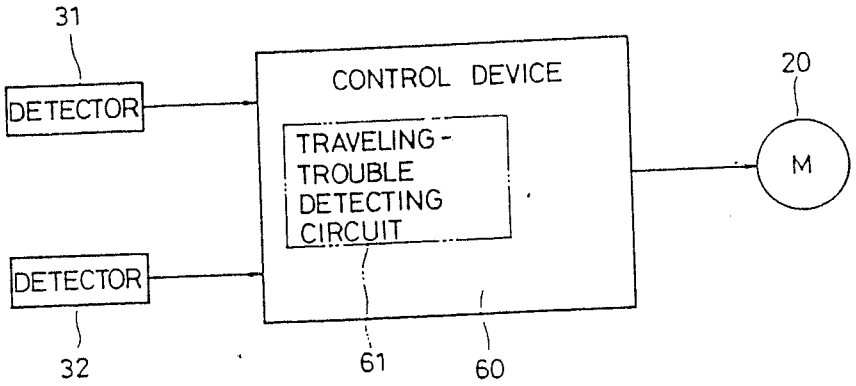
FIG. 3 is a control block diagram of a traveling-trouble dealing system for the traveling-trouble detecting device.

The drive motor 20 is employed not only to drive the fixing roll pair 81, but also to drive driving mechanisms associated with transportation of the fan-folded form 10, such as a driving mechanism for rotation of the photo-conductive drum 1 and other driving mechanisms. Accordingly, it is possible to control transportation of the fan-folded form 10 by control of rotation of the drive motor 20. As shown in FIG. 3 which is a control block diagram of a traveling-trouble dealing system, the drive motor 20 is controlled in its rotative driving by a control device 60 which includes a traveling-trouble detecting circuit 61 serving as traveling-trouble detecting means.

Referring back to FIGS. 1 and 2, the direction-regulating feed mechanism 9 comprises a pair of endless tension belts 91 and 91 which are arranged respectively below the opposite side edge portions of the fan-folded form 10 traveling from the transferring station 7 toward the fixing station 8 along the predetermined path. The tension belts 91 and 91 extend parallel to the traveling direction and are capable of running with a predetermined traveling resistance.

Each of the tension belts 91 is provided on an outer peripheral surface with a plurality of projections 91A which are arranged in a single row along the entire periphery of the tension belt 91. The projections 91A on each tension belt 91 are spaced from each other at intervals of ½ inch equal to that of the sprocket holes 10A formed along a corresponding one of the opposite side edges of the fan-folded form 10, so that the projections 91A are engageable respectively with the sprocket holes 10A as shown in FIG. 2. Thus, the tension belts 91 and 91 can be driven to run with transportation of the fan-folded form 10. As described previously, each of the tension belts 91 has the predetermined traveling resistance. Accordingly, the tension belts 91 and 91 serve to apply a tension to a portion of the fan-folded form 10 extending between the direction-regulating feed mechanism 9 and the fixing station 8 to prevent skewing and meandering of the fan-folded form 10, and also serve to automatically restore the fan-folded form 10 to the regular position even if such skewing and meandering occur.

Each of the detectors 31 and 32 for detecting the respective side edges of the fan-folded form 10 is formed by a so-called photo-interrupter of transmissive type in which a light source and a light-receiving element are spaced from each other by a predetermined distance in facing relation. Each of the detectors 31 and 32 is so designed as to detect existence of a light-shielding shielding object between the light source and the light-receiving element, depending upon presence and absence of incidence of light emitted from the light source upon the light-receiving element. The detectors 31 and 32 are fixedly mounted respectively to opposite side walls of a chassis 40 at a location between the direction-regulating feed mechanism 9 and the fixing station 8. Each of the detectors 31 and 32 is positioned such that during normal traveling of the fan-folded form 10, the optical path from the light source to the light-receiving element is located a predetermined distance X inwardly from a corresponding one of the opposite side edges of the fan-folded form 10 as clearly shown in FIG. 4.

The position of the detecting part of each of the detectors 31 and 32, i.e., the distance X from the corresponding side edge of the fan-folded form 10 to the detecting position may optionally be set in consideration of a restorable amount of skewing and the transport velocity of the fan-folded form 10, and a clock cycle and a set period of time in the traveling-trouble detecting circuit 61 subsequently to be described.

The traveling-trouble dealing system for the fan-folded form 10 including the traveling-trouble detecting device 60 is arranged, as shown in FIG. 3, such that the traveling-trouble detecting circuit 61 detects abnormal traveling conditions on the basis of signals from the detectors 31 and 32 in a manner subsequently to be described, and the control device 60 controls the drive motor 20 so as to interrupt its transport driving.

The circuit arrangement of the traveling-trouble detecting device 60 for the fan-folded form 10 will next be described with reference to FIG. 5.

Signals $PT_1$ and $PT_2$ from the respective detectors 31 and 32 arranged respectively adjacent the opposite side edges of the fan-folded form 10 are inputted to a NOR circuit 61A which takes a logical sum of these signals $PT_1$ and $PT_2$ and which outputs the logical sum as an output signal $S_1$. The output signal $S_1$ is inputted, as a clear signal, to a counter 61B having a $Q_n$ output terminal from which an Error signal is taken out. The $Q_n$ output terminal of the counter 61B is adapted to output a signal on the basis of a preset count value. Subsequently to be described, the count value is set on the basis of the relationship between the time duration for which, it is considered, skewing or meandering of the fan-folded form 10 is restorable, and a cycle of clock signals Clock to the counter 61B. In addition, the clock signals Clock based on this relationship are inputted to a clock input CLK of the counter 61B. Further, the counter 61B is brought to a clear state when the clear input is at a High level.

The operation of the traveling-trouble detecting device 60 will next be described with reference to FIG. 6 which shows a time chart of various signals including the $PT_1$, $PT_2$, $S_1$, Clock and Error signals when the fan-folded form 10 travels normally.

The optical path from the light source to the light receiving element in each of the detectors 31 and 32 is located in the predetermined position adjacent a corresponding one of the opposite side edges of the fan-folded form 10. During normal traveling of the fan-folded form 10, the optical paths in the respective detectors 31 and 32 are intercepted respectively by the opposite side edge portions of the fan-folded form 10, so that the signals $PT_1$ and $PT_2$ from the respective detectors 31 and 32 are brought respectively to the Low levels. Accordingly, the output signal $S_1$ from the NOR circuit 61A is brought to the High level. Since this signal $S_1$ serves as the clear signal for the counter 61B, the counter 61B is brought to the clear state and does not execute the counting operation. Thus, the $Q_n$ output of the counter 61B, that is, the Error signal is brought to the Low level. The fact that the Error signal is at the Low level indicates that the fan-folded form 10 is transported normally.

The operation will next be described as to the case where the fan-folded form 10 skews or meanders so that the abnormal traveling occurs. In this case, because of the defective transportation, one of the side edge portions of the fan-folded form 10 is out of the optical path in a corresponding one of the detectors 31 and 32, or both the side edge portions of the fan-folded form 10 are respectively out of the optical paths in the respective detectors 31 and 32. Accordingly, at least one of the signal $PT_1$ and $PT_2$ is brought to the High level. In response to the change of at least one of the signals $PT_1$ and $PT_2$ to the High level, the output signal $S_1$ from the NOR circuit 61 falls down to the Low level, because the output signal $S_1$ is the logical sum of the signals $PT_1$ and $PT_2$.

For ease of understanding, FIG. 7 shows the time chart of the various signals in the case that the transportation defect on the side of the detector 31 causes the signal $PT_1$ to be brought to the High level. It is to be understood, however, that as described previously, the transportation defects on the side of the detector 32 or on both sides of the detectors 31 and 32 also cause the signal $S_1$ to be brought to the Low level. Since the signal $S_1$ serves as the clear signal for the counter 61B, the latter begins to count the clock signals Clock from the moment the signal $S_1$ is brought to the Low level. As the counter 61B has completed to count the preset count value, for example, a value $C_n$ shown in FIG. 7, the $Q_n$ output is brought to the High level to inform that the counting has been completed. On and after the point of time the Error signal from the $Q_n$ output is brought to the High level, it is judged that traveling of the fan-folded form 10 has been brought to the abnormal state.

For example, if setting is made in such a manner that one cycle of the clock signals Clock is 1 ms and that the $Q_n$ output of the counter 61B is brought to the High level after counting of 300 clock signals, the operation is as follows.

As abnormal traveling of the fan-folded form 10 is detected by at least one of the detectors 31 and 32, the output signal $S_1$ from the NOR circuit 61A falls down to the Low level. In response to the falling-down, the counter 61B initiates its counting operation. As the counter 61B counts 300 clock signals, in other words, as 300 ms elapse, traveling of the fan-folded form 10 is judged to be abnormal, so that the Error signal is brought to the High level. From this, it may be considered that the counting value $C_n$ shown in FIG. 7, for example, is replaced by a set period of time of 300 ms.

If the signal from at least one of the detectors 31 and 32 indicates that the fan-folded form 10 is well restored naturally to the normal traveling state before expiration of the period of time of 300 ms, the signal $S_1$ mentioned previously is returned to the High level. This brings the counter 61B to the clear state, so that the Error signal is maintained unchanged and at the Low level. This aspect is shown in FIG. 8 which illustrates that the fan-folded form 10 is naturally restored to the normal traveling state in the case shown in FIG. 7.

In this manner, the Error signal is maintained at the Low level indicating the normal traveling state of the fan-folded form 10, until the counter 61B completes to count the preset counting value $C_n$, in other words, until the preset period of time expires. On and after expiration of the present period of time, the Error signal is brought to the High level, to inform traveling abnormality of the fan-folded form 10. The reason why the Error signal is delayed by the preset period of time from occurrence of the abnormal traveling is that although the fan-folded form 10 skews or meanders during transportation, there may be a case where the amount of skewing or meandering is within an allowance or tolerance so that the fan-folded form 10 does not result in a traveling defect but is restored to the regular position and, in this case, the traveling of the fan-folded form 10 should not be judged to be abnormal, but be judged to be normal.

As the traveling abnormality of the fan-folded form 10 is detected as being the abnormal traveling state, the Error signal at the High level is outputted from the counter 61B. On the basis of the Error signal, the control device 60 halts operation of the drive motor 20, thereby making it possible to interrupt transportation of the fan-folded form 10 and printing by the printer.

With the arrangement described above, it is possible to prevent the fan-folded form 10 from being jammed and bitten into the transport system and the drive system, even when skewing or meandering of the fan-folded form 10 occurs which is incapable of being restored.

Although it has been described in the embodiment illustrated in FIGS. 1 through 8 that the continuous form is the fan-folded form 10 having provided therein with the sprocket holes 10A, the embodiment is equally applicable to a continuous form having no sprocket holes. In this case, the detectors 31 and 32 may be arranged at any location between the photoconductive drum 1 and the fixing station 8. Further, the invention is not particularly limited to the arrangement in which the continuous form is driven to travel by the fixing roll pair 81 of the fixing station 8. It is needless to say that the invention is applicable to the arrangement which is provided with a mechanism exclusive for driving the continuous form to travel.

Moreover, although each of the detectors 31 and 32 has been described as being the photo-interrupter of transmissive type, it is of course that the detector may be formed by a photo-interrupter of reflective type.

Furthermore, it has been described in the above embodiment that the position of the optical path in each of the detectors 31 and 32, that is, the detecting position is located inwardly of a corresponding one of the opposite side edges of the fan-folded form 10 and that interception of the optical path represents the normal traveling state. However, the arrangement may be such that the detecting position is located outwardly of the corresponding side edge of the fan-folded form 10 and that continuation of the optical path represents the normal traveling state. Such arrangement can similarly be handled if consideration is made to positive and negative of each signal.

In the traveling-trouble detecting device for the continuous form, which is incorporated in the printer constructed as above, the opposite side edge portions of the continuous form are detected respective by the pair of detectors, and the error signal representative of the abnormal traveling of the continuous form is outputted when the detecting signal from at least one of the detectors continues for the preset period of time or more, in other words, when skewing or meandering of the continuous form equal to or greater than a predetermined amount continues for the predetermined period of time or more. If this error signal is utilized as a stop signal for the transport system and the drive system, it is made possible to prevent the continuous form from being jammed and bitten into the transport system and the drive system.

Thus, a burden applied to the transport system and the drive system due to biting of the continuous form thereinto is made nil, making it possible to prevent malfunction and damage of the printer due to abnormal traveling of the continuous form.

FIGS. 9 and 10 show a modification of the invention, in which the detectors 31 and 32 are arranged such that the light emitted from the light source of each of the detectors 31 and 32 is incident upon the light-receiving element of the detector only each time the sprocket holes 10A in a corresponding one of the opposite side edge portions of the fan-folded form 10 cross successively the optical path between the light source and the light-receiving element. Like the embodiment illustrated in FIGS. 1 and 2, the detectors 31 and 32 are located between the direction-regulating mechanism 9 and the fixing station 8 and are fixedly mounted respectively to the opposite side walls of the chassis 40 in such a manner that, as shown in FIG. 9, the optical path in each of the detectors 31 and 32 extends perpendicularly to a line interconnecting the centers of the respective sprocket holes 10A formed in a corresponding one of the opposite side edge portions of the fan-folded form 10. Each of the detectors 31 and 32 in the modification illustrated in FIGS. 9 and 10 includes a drive circuit for the photo-interrupter and a waveform shaping circuit for shaping the output from the light-receiving element of the photo-interrupter into a rectangular waveform.

As shown in FIG. 10, a transport-trouble detecting circuit 161 of the modification is composed of an OR circuit 161A and a re-triggerable monostable multivibrator (hereinafter referred to simply as "re-triggerable mono-multi") 161B which is re-triggerable in response to rise (positive edge) of the signal $S_{11}$. Signals $PT_{11}$ and $PT_{12}$ from the respective detectors 31 and 32 arranged respectively adjacent the opposite side edges of the fan-folded form 10 are inputted to the OR circuit 161A which takes a logical sum of these signals $PT_{11}$ and $PT_{12}$. The re-triggerable mono-multi 161B has an input terminal IN to which an output signal $S_{11}$ from the OR circuit 161A is inputted. When a Q output of the re-triggerable mono-multi 161B is brought to a Low level, the Q output serves as an Error signal.

In the re-triggerable mono-multi 161B, re-triggering is permitted on and after expiration of a time duration $T_x$ which is set by resistors R and capacitors C mounted outside of the re-triggerable mono-multi 161B. The time duration $T_x$ is determined on the basis of the transport velocity of the fan-folded form 10 and the pitch of the sprocket holes 10A, and is selected to one within which, it is considered, skewing or meandering of the fan-folded form 10 can automatically be restored.

The operation of the traveling-trouble detecting circuit 161 will next be described with reference to time charts of the various signals including the $PT_{11}$, $PT_{12}$, $S_{11}$ and Error signals, illustrated in FIGS. 11 through 14.

Figure 11:
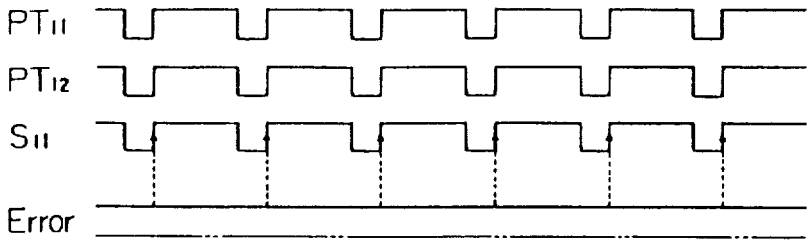

FIG. 11 shows the time chart in the case that the fan-folded form 10 travels normally. In this case, the optical path in each of the detectors 31 and 32 is intersected generally at right angles with the line interconnecting the centers of the respective sprocket holes 10A in a corresponding one of the opposite side edge portions of the fan-folded form 10, so that the frequencies of the respective signals $PT_{11}$ and $PT_{12}$ are synchronized with the transport velocity of the fan-folded form 10. Accordingly, each time the sprocket holes 10A in the fan-folded form 10 cross successively the optical paths in the respective detectors 31 and 32, the signals $PT_{11}$ and $PT_{12}$ are brought respectively to the Low levels. On the other hand, each time the optical paths in the respective detectors 31 and 32 are intercepted successively by sections of the fan-folded form 10 extending between the adjacent sprocket holes 10A, the signals $PT_{11}$ and $PT_{12}$ are brought respectively to the High levels.

Since the fan-folded form 10 is traveling normally, the signals $PT_{11}$ and $PT_{12}$ are generally identical in phase with each other. Accordingly, the output signal $S_{11}$ from the OR circuit 161A, which takes the logical sum of these signals $PT_{11}$ and $PT_{12}$, is also generally identical in phase with the signals $PT_{11}$ and $PT_{12}$.

The re-triggerable mono-multi 161B is triggered at rise (positive edge) of the signal $S_{11}$. However, if the re-triggering permissible time duration $T_x$ is set to one sufficiently longer than the rise cycle of the signal $S_{11}$, the Q output is always maintained at the High level. The traveling state of the fan-folded form 10 is judged to be normal when the Q output is maintained at the High level.

Figure 12:
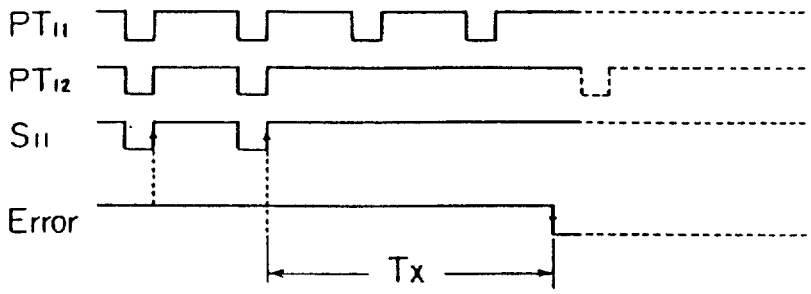

FIG. 12 shows the time chart of the various signals in the case that the side edge of the fan-folded form 10 on the side of the detector 32 skews toward the detector 31 so that a strip-like region interconnecting the sprocket holes 10A in the side edge portion of the fan-folded form 10 on the side of the detector 32 is out of the optical path in the detector 32.

In the case illustrated in FIG. 12, if the side edge of the fan-folded form 10 on the side of the detector 31 travels normally, the signal $PT_{11}$ is brought to the Low level each time the sprocket holes 10A cross successively the optical path in the detector 31, and is brought to the High level each time the optical path is intercepted successively by the sections of the fan-folded form 10 extending between the adjacent sprocket holes 10A, similarly to the case illustrated in FIG. 11.

As the side edge of the fan-folded form 10 on the side of the detector 32 skews toward the detector 31, the output signal $PT_{12}$ from the detector 32 keeps the High level from the moment the strip-like region interconnecting the sprocket holes 10A on the side of the detector 32 is out of the optical path in the detector 32. In that case, since the OR circuit 161A takes the logical sum of the signals $PT_{11}$ and $PT_{12}$, the aforesaid change in output of the signal $PT_{12}$ appears, as it is, in the signal $S_{11}$.

Accordingly, the re-triggerable mono-multi 161B, which has been re-triggered in synchronism with the sprocket holes 10A in the fan-folded form 10, is no longer triggered on and after the last rise (positive edge) of the signal $S_{11}$ which corresponds to the moment the strip-like region interconnecting the sprocket holes 10A is out of the optical path in the detector 32.

As a result, the Q output falls down to the Low level after expiration of the preset re-triggering permissible time duration $T_x$ mentioned previously. The Error signal on and after the point of time the Q output is brought to the Low level represents the abnormal traveling state of the fan-folded form 10. In this manner, occurrence of an error is detected.

Figure 13:
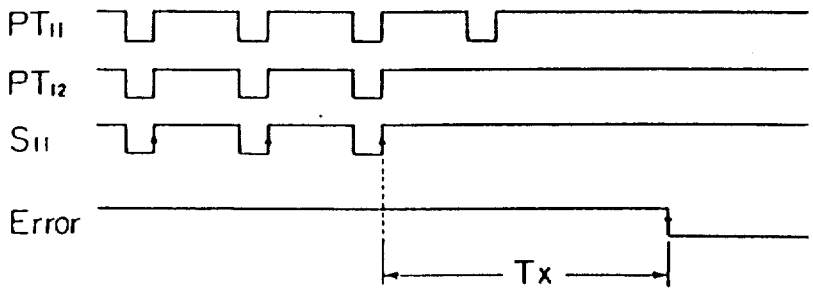

FIG. 13 shows the time chart of various signals in the case that the opposite side edges of the fan-folded form 10 approach the longitudinal central axis thereof so that each of the optical paths in the respective detectors 31 and 32 is out of the strip-like region interconnecting the sprocket holes 10A in a corresponding one of the opposite side edge portions of the fan-folded form 10.

In the case illustrated in FIG. 13, a change in output of the signal from one of the detectors 31 and 32 whose optical path is first out of the strip-like region interconnecting the sprocket holes 10A, appears in the signal $S_{11}$. In the example shown in FIG. 13, the signal $PT_{12}$ represents that the optical path in the detector 32 is first out of the strip-like region interconnecting the sprocket holes 10A. Like the example shown in FIG. 12, the Q output from the re-triggerable mono-multi 161B falls down to the Low level after expiration of the re-triggering permissible time duration $T_x$ from the last rise (positive edge) of the signal $S_{11}$. Occurrence of an error is detected by falling of the Q output down to the Low level.

In both the examples shown respectively in FIGS. 12 and 13, the Error signal due to occurrence of the abnormal traveling state of the fan-folded form 10 is outputted from the re-triggerable mono-multi 161B after expiration of the re-triggering permissible time duration $T_x$.

There may be a case where because an amount of skewing or an amount of meandering of the fan-folded form 10 is small, the fan-folded form 10 is well restored naturally to the regular position after a while, under the action of the back-tension due to the direction-regulating feed mechanism 9. In this case, it is of course that a change in output of each of the signal $PT_{11}$ and $PT_{12}$ from the respective detectors 31 and 32 appears in the signal $S_{11}$ from the OR circuit 161A. However, if skewing or meandering of the fan-folded form 10 is restored within the re-triggering permissible time duration $T_x$, the re-triggerable mono-multi 161B is re-triggered by the signal $S_{11}$ indicating that the fan-folded form 10 has been returned to the normal traveling state before the Q output is brought to the Low level. Accordingly, the Q output is maintained at the High level and continues to indicate the normal traveling state.

To this end, it is necessary to set the re-triggering permissible time duration $T_x$, in anticipation of a period of time within which, it is considered, skewing or meandering of the fan-folded form 10 may naturally be restored. In fact, the time duration $T_x$ is set in this manner.

In the example shown in FIG. 12, in which a change in traveling of the fan-folded form 10 occurs only on the side of the detector 32. It may be considered, however, that in practice, such change in traveling occurs only on the side of the detector 31, or on both sides of the detectors 31 and 32 like the example shown in FIG. 13. In either case, since the OR circuit 161A takes the logical sum, the change in traveling after all appears in the signal $S_{11}$. Thus, the traveling abnormality can be detected by falling of the Q output down to the Low level.

As the traveling abnormality of the fan-folded form 10 is detected as being the abnormal traveling state in the manner as described above, the Error signal of the Low level is outputted from the Q output terminal of the re-triggerable mono-multi 161B. The Error signal causes the control device 60 (see FIG. 3) to halt operation of the drive motor 20, making it possible to interrupt transportation of the fan-folded form 10 and printing by the printer.

Thus, with the arrangement illustrated in FIGS. 9 and 10, it is possible to prevent the fan-folded form 10 from being jammed and bitten into the transport system and the drive system, even if skewing or meandering occurs which is incapable of being restored.

Further, another modification can be made such that the signals $PT_{11}$ and $PT_{12}$ from the respective detectors 31 and 32 are inverted in logic by inverters or the like, respectively into signals $\overline{PT_{11}}$ and $\overline{PT_{12}}$ and that the re-triggerable mono-multi 161B modified to negative-edge-going type is triggered at negative of the signal $S_{11}$ which is the logical sum of the signals $\overline{PT_{11}}$ and $\overline{PT_{12}}$. If such modification is made, the various signals are brought to their respective forms shown in FIG. 14.

Figure 14:
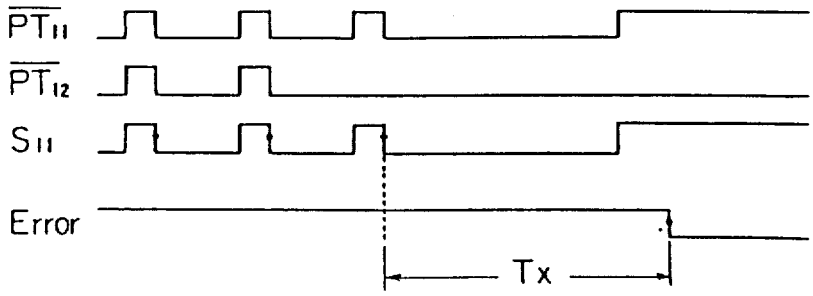

In the modification shown in FIG. 14, the Error signal is outputted after expiration of the re-triggering permissable time duration $T_x$ from a point of time the signals $\overline{PT_{11}}$ and $\overline{PT_{12}}$ are both brought respectively to the Low levels so that no pulse signals corresponding respectively to the sprocket holes 10A in the fan-folded form 10 are outputted. This aspect is specifically shown in FIG. 14, in which only when the strip-like region interconnecting the sprocket holes 10A in each of the opposite side edge portions of the fan-folded form 10 is out of the optical path in a corresponding one of the detectors 31 and 32 for a given period of time, it is judged that the fan-folded form 10 travels abnormally, and the Error signal is outputted. By doing so, it is possible to broad the scope or the state to be considered to be normal in transportation, and to loosen the state to be considered to be the traveling abnormality.

Furthermore, in the above modification shown in FIGS. 9 and 10, the example has been described in which the signal $S_{11}$ from the OR circuit 161A on the basis of the signals $PT_{11}$ and $PT_{12}$ from the respective detectors 31 and 32 serves as the trigger signal for the re-triggerable mono-multi 161B. However, the invention is not limited to this example. For example, the arrangement may be such that the OR circuit 161A is omitted, that a pair of re-triggerable mono-multis of rise-trigger type are provided, their respective trigger signals being formed respectively by the signals $PT_{11}$ and $PT_{12}$ independently of each other, and that an error signal is obtained on the basis of Q outputs or Q outputs from the respective re-triggerble mono-multis.

With the above arrangement, it is possible to detect a condition wherein the state, in which the strip-like region interconnecting the sprocket holes 10A in each of the opposite side edge portions of the fan-folded form 10 is out of the optical path in a corresponding one of the detectors 31 and 32, continues for the re-trigger permissible time duration $T_x$ and more. Thus, the abnormal traveling state of the fan-folded form 10 can be detected in a more severe manner.

FIGS. 15 and 16 show another modification of the invention. As shown in FIG. 15, a traveling-trouble detecting means is designed to produce, on the basis of the signals from the respective detectors 31 and 32, right and left error signals $R_{error}$ and $L_{error}$ which represent traveling abnormalities of the fan-folded form subsequently to be described. On the basis of these right and left error signals $R_{error}$ and $L_{error}$, a control device 260 judges whether or not the traveling abnormalities of the fan-folded form are restorable. When the traveling abnormalities are not restorable, the control device 260 controls the drive motor 20 so as to interrupt its driving of the fan folded form to travel. Further, by the use of a right-hand error-indicator lamp 262R and a left-hand error-indicator lamp 262L, the control device 260 can display that the transport abnormalities occur on the right-hand side edge or the left-hand side edge or both side edges of the fan-folded form.

A specific circuit arrangement of the transport trouble detecting circuit 161 will be described with reference to FIG. 16.

Flow of the signals will first be traced. In FIG. 16, each of the detectors 31 and 32 arranged as shown in FIG. 9 includes a drive circuit for the photo-interrupter and a waveform shaping circuit for shaping the output from the light-receiving element of the photo-interrupter to a rectangular waveform. The signals $PT_{11}$ and $PT_{12}$ from the respective detectors 31 and 32 are first inputted respectively to a pair of data input terminals $D_1$ and $D_2$ of a latch circuit 261A which has a pair of output terminals $Q_1$ and $Q_2$. The $R_{error}$ signal is outputted from the output terminal $Q_1$ as an error signal representative of detection of the abnormal traveling state of the right-hand side edge of the fan-folded form 10. On the other hand, the $L_{error}$ signal is outputted from the output terminal $Q_2$ as an error signal representative of detection of the abnormal traveling state of the left-hand side edge of the fan-folded form 10.

In order to make the signals $R_{error}$ and $L_{error}$ take on respective meanings as the right-hand error signal and the left-hand error signal, the latch circuit 261A has inputted thereto, as a reset signal, a signal $S_{22}$ from a Q output of a re-triggerable mono-multi 261B. The latch circuit 261A has also inputted thereto, as clock signals, a signal $S_{23}$ from a PLL circuit 261D.

The output signal $S_{23}$ from the PLL circuit 261D, which serves as clock signals, is inputted to the re-triggerable mono-multi 261B, and the signal $S_{22}$ is obtained at the Q output of the re-triggerable mono-multi 261B.

In the re-triggerable mono-multi 261B, the time duration $T_x$ during which re-triggering is permissible is determined by resistors R and capacitors C which are mounted outside of the re-triggerable mono-multi 261B. This determination will be described later.

The signal $S_{23}$ is obtained in such a manner that a signal $S_{21}$, which is obtained by taking a logical sum of the signals $PT_{11}$ and $PT_{12}$, is inputted to the PLL circuit 261D subsequently to be described.

The traveling-trouble detecting circuit 261 is constructed by the latch circuit 261A, the re-triggerable mono-multi 261B, the OR gate 261C and the PLL circuit 261D, which are so connected that the various signals flow and are obtained in the manner mentioned above.

The operation of the traveling-trouble detecting circuit 261 will next be described with reference to time charts of the various signals including the $PT_{11}$, $PT_{12}$, $S_{21}$, $S_{22}$, $S_{23}$, $R_{error}$ and $L_{error}$ signals, illustrated in FIGS. 17 through 20.

Figure 17:
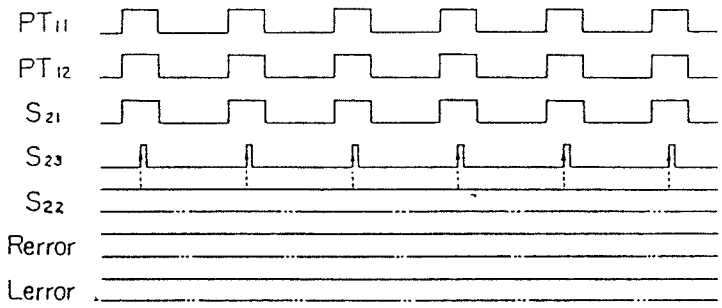

FIG. 17 shows the time chart in the case that the fan-folded form 10 travels normally. In this case, each of the optical paths in the respective detectors 31 and 32 extends substantially perpendicularly to the line interconnecting the centers of the respective sprocket holes 10A in a corresponding one of the opposite side edge portions of the fan-folded form 10. Accordingly, the frequencies of the respective signals $PT_{11}$ and $PT_{12}$ are synchronized with the transport velocity of the fan-folded form 10. Each of the signals $PT_{11}$ and $PT_{12}$ is brought to the High level each time the sprocket holes 10A cross successively the optical path in a corresponding one of the detectors 31 and 32, and is brought to the Low level each time the optical path in the detector is intercepted successively by the sections of the fan-folded form 10 extending between the adjacent sprocket holes 10A.

Since the fan-folded form 10 is traveling normally, the signals $PT_{11}$ and $PT_{12}$ are generally identical in phase with each other. The signal $S_{21}$, which is the logical sum of the signals $PT_{11}$ and $PT_{12}$, is also generally identical in phase with the signals $PT_{11}$ and $PT_{12}$.

Then, the signal $S_{21}$ is inputted to the PLL circuit 261D at the subsequent step. At the PLL circuit 261D, as shown in FIG. 17, the signal $S_{21}$ is converted to the signal $S_{23}$ which is identical with the transport cycle of the sprocket holes 10A in the fan-folded form 10 and which is synchronized with the vicinity of the center of the High level duration of the signal $S_{21}$, in other words, the duration for which one of the sprocket holes 10A in each of the opposite side edges of the fan-folded form 10 crosses the optical path in a corresponding one of the detectors 31 and 32. The PLL circuit 261D is so designed that when the signal $S_{21}$ is not inputted, the PLL circuit 261D does not output the signal $S_{23}$ in response thereto.

At rise (positive edge) of the signal $S_{23}$, the latch circuit 261A latches the signals $PT_{11}$ and $PT_{12}$ which are data input signals at respective $D_1$ and $D_2$. Accordingly, the signals $R_{error}$ and $L_{error}$ from the respective output terminals $Q_1$ and $Q_2$ are both brought always to the respective High levels. At this time, if the signal $S_{22}$ that is the reset signal for the latch circuit 261A is brought to the Low level, the latch circuit 261A is reset. This is inconvenience. Therefore, the re-triggering permissible time duration $T_x$ (see FIGS. 19 and 20) is set to a value equal to or longer than one cycle of the signal $S_{23}$, in order for the re-triggerable mono-multi 261B to continue to be re-triggered by the signal $S_{23}$.

Thus, the signals $R_{error}$ and $L_{error}$ are always brought to the respective High levels during normal traveling of the fan-folded form 10. This condition is judged to be the normal traveling state.

Figure 18:
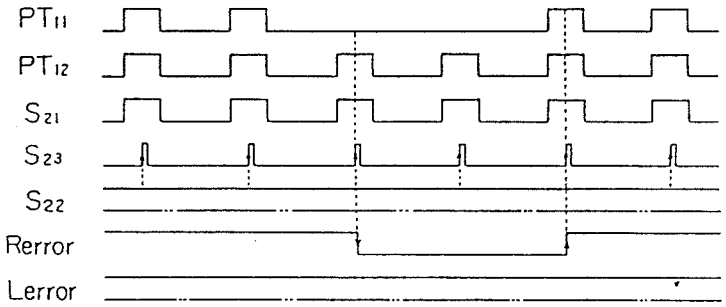

FIG. 18 shows the time chart of the various signals in the case that a traveling abnormality such as skewing or the like of the fan-folded form 10 occurs on the side of the right-hand detector 31, but the traveling state of the fan-folded form 10 is well restored to the normal traveling state after a while under the action of the back-tension or the like for the reasons that the amount of skewing or the like is small. The aspect of the respective right-hand and left-hand error signals in the abnormal traveling state will be described with reference to FIG. 18.

A case will be considered where leftward skewing occurs on the right side of the fan-folded form 10 so that the strip-like region interconnecting the sprocket holes 10A is once out of the optical path in the detector 31. Even in this case, if the amount of skewing is still small, the optical path in the detector 31 still crosses the sections of the fan-folded form 10 other than the sprocket holes 10A. After this state continues for a while, if the fan-folded form 10 is well restored naturally to the regular position, the signal $PT_{11}$ takes the form shown in FIG. 18 in which the signal $PT_{11}$ of the Low level continues during the period of the abnormal traveling state.

On the other hand, if the fan-folded form 10 is transported substantially normally on the side of the detector 32, the signal $PT_{12}$ is generally the same as that during normal traveling of the fan-folded form 10, though, in practice, the signal $PT_{12}$ is slightly shortened in the duration of the High level. Since the signal $S_{21}$ is the logical sum of the signals $PT_{11}$ and $PT_{12}$, the signal $S_{21}$ is substantially identical with that during normal traveling of the fan-folded form 10. Likewise, the signals $S_{22}$ and $S_{23}$ are generally the same as those during the normal traveling of the fan-folded form 10. Since, however, the signal $R_{error}$ is one in which the signal $PT_{11}$ is latched at rise (positive edge) of the signal $S_{23}$, the period during which the signal $PT_{11}$ is at the Low level, i.e., the period during which the optical path in the detector 31 is out of the strip-like region interconnecting the sprocket holes 10A and crosses the section of the fan-folded form 10 except for the sprocket holes 10A such as the side edge section of the fan-folded form 10, is detected at the cycle of rise (positive edge) of the signal $S_{23}$. The error signal concerning the right-hand side edge of the fan-folded form 10 is determined by the state in which the signal $R_{error}$ is brought to the Low level, and by the duration of the Low level. It is judged from this error signal that the abnormal traveling state has occurred.

In the example illustrated in FIG. 18, consideration has been made to the traveling abnormality on the side of the detector 31, that is, on the right-hand side edge of the fan-folded form 10. However, the traveling abnormality on the side of the detector 32, that is, on the left-hand side edge of the fan-folded form 10 can be detected in a manner like that described above, by the fact that the signal $L_{error}$ is brought to the Low level. The detecting signal serves as the error signal concerning the left-hand side edge of the fan-folded form 10. On the basis of this error signal, it is judged that the abnormal traveling state has occurred.

Figure 19:
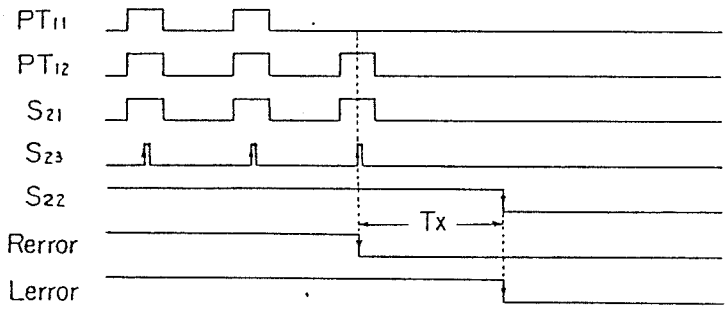

FIG. 19 shows the time chart of the various signals in the case that the traveling abnormalities of the fan-folded form 10 occur on the side of the detector 31, i.e., on the right-hand side, the traveling abnormality subsequently occurs also on the side of the detector 32, i.e., on the left-hand side, and the traveling abnormalities continue and the fan-folded form 10 cannot be restored to its normal state so that optical paths in the respective detectors 31 and 32 cross the sections of the fan-folded form 10 such as the side edge sections thereof except for the sprocket holes 10A. In this case, because of occurrence of the traveling abnormalities of the fan-folded form 10, the optical path in each of the right-hand and left-hand detectors 31 and 32 is out of the strip-like region interconnecting the sprocket holes 10A in a corresponding one of the opposite side edge portions of the fan-folded form 10. Consideration is now made to the case where the optical paths are still maintained intersected with the sections of the fan-folded form 10 except for the sprocket holes 10A. Accordingly, the signals $PT_{11}$ and $PT_{12}$ are both brought respectively to the Low levels and, subsequently, this state continues.

At this time, a change of one of the signals $PT_{11}$ and $PT_{12}$, which corresponds to the traveling abnormality having occurred lately, that is, a change of the signal $PT_{12}$ in the case illustrated in FIG. 19, appears lastly in the signal $S_{21}$. The signal $S_{23}$ from the PLL circuit 261D disappears in response to the signal $S_{21}$. Accordingly, the latch circuit 261A latches the Low level of the signal $PT_{11}$ at the last rise (positive edge) of the signal $S_{23}$, and is reset in response to falling of the output signal $S_{22}$ from the re-triggerable mono-multi 261B, down to the Low level after expiration of the time duration $T_x$ from the last rise (positive edge) of the signal $S_{23}$.

In this manner, the signals $R_{error}$ and $L_{error}$ that are the error signals of the Low level are produced respectively from the $Q_1$ and $Q_2$ outputs of the latch circuit 261A, in the order of occurrence of the traveling abnormalities, that is, in the order of the signal $R_{error}$ and the signal $L_{error}$.

If the traveling abnormalities of the fan-folded form 10 occur in relation opposite in the order to the example illustrated in FIG. 19, the traveling-trouble detecting circuit 261 operates in a similar manner, and the error signals are produced in the order of the signal $L_{error}$ and the signal $R_{error}$.

Figure 20:
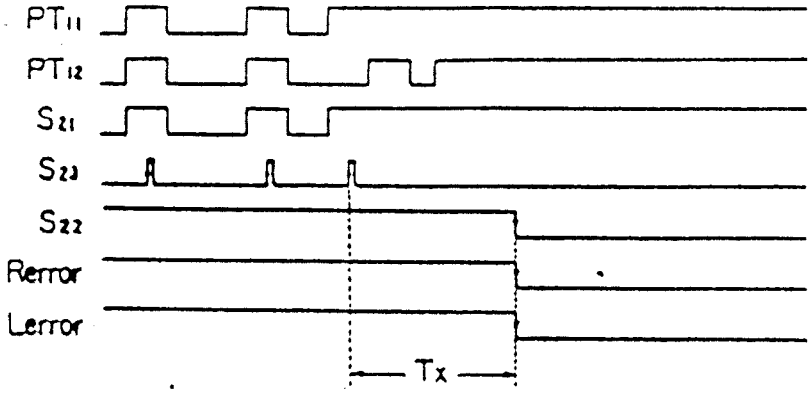

FIG. 20 shows the time charts of the various signals. The example illustrated in FIG. 20 is the same as that shown in FIG. 19 in that the traveling abnormalities of the fan-folded form 10 occur on both sides of the right-hand and left-hand detectors 31 and 32. In the example illustrated in FIG. 20, however, such sudden traveling abnormalities occur that the fan-folded form 10 is severed along perforation formed along each of the opposite side edges of the fan-folded form 10, and the opposite side edge portions having provided therein the sprocket holes 10A are severed from the central section of the fan-folded form 10, with the result that the section, except for the sprocket holes 10A, of each of the opposite side edge portions of the fan-folded form 10 is entirely out of the optical path in a corresponding one of the detectors 31 and 32. In this case, the signals $PT_{11}$ and $PT_{12}$ are both brought respectively to the high levels in response to sudden occurrence of the traveling abnormalities. Accordingly, the signal $S_{21}$ takes the form in compliance with one of the signals $PT_{11}$ and $PT_{12}$ which is first brought to the High level, that is, the signal $PT_{11}$ in the case illustrated in FIG. 20.

The PLL circuit 261D outputs the signal $S_{23}$ in synchronism with the last rise (positive edge) of the signal $S_{21}$ and, on and after that, does not output the signal $S_{23}$. The latch circuit 261A carries out the latch operation at the last rise (positive edge) of the signal $S_{23}$.

It is impossible for this timing, however, to judge the abnormalities of the signals $PT_{11}$ and $PT_{12}$ on the basis of the signals $R_{error}$ and $L_{error}$ that are the error signals. Thus, such inconvenience occurs that the traveling state of the fan-folded form 10 cannot correctly be judged if the way things are going.

In view of the above, falling of the signal $S_{22}$ down to the Low level after expiration of the time duration $T_x$ from the last rise (positive edge) of the signal $S_{23}$ is utilized to reset the latch circuit 261A, thereby bringing both the signals $R_{error}$ and $L_{error}$ to their respective Low levels.

By doing so, even if the sprocket holes 10A and the sections, except for the sprocket holes 10A, of the opposite side edge portions of the fan-folded form 10 are all out of the optical paths in the respective right-hand and left-hand detectors 31 and 32, it is made possible to detect the traveling abnormalities of the fan-folded form 10.

In this manner, as the traveling abnormalities on the opposite sides of the fan-folded form 10 are detected as being the abnormal traveling state, the error signals of the Low levels are outputted respectively from the $Q_1$ and $Q_2$ output terminals of the latch circuit 261A, respectively as the right-hand and left-hand signals $R_{error}$ and $L_{error}$.

In response to the respective right-hand and left-hand error signals, the control device 260 monitors the time durations of the respective right-hand and left-hand error signals. The control device 260 judges that the traveling abnormalities incapable of being restored occur, if the error signals continue for their respective predetermined periods of time. On the basis of this judgment, the control device 260 halts operation of the drive motor 20. Thus, it is made possible to interrupt transportation of the fan-folded form 10 and printing by the printer. At the same time, the control device 260 can also perform the error display on the basis of the judgment of the abnormal traveling state in the following manner. That is, if the traveling abnormality incapable of being restored occurs on the right-hand side of the fan-folded form 10, the control device 260 turns on the right-hand error indicator lamp 262R, while the traveling abnormality occurs on the left-hand side, the control device 260 turns on the left-hand error indicator lamp 262L. Further, if the traveling abnormalities occur on both sides of the fan-folded form 10, the control device 260 turns on both the right-hand and left-hand error indicator lamps 262R and 262L.

With the arrangement described above, it is possible to prevent the fan-folded form 10 from being jammed and bitten into the transport system and the drive system, even when the skewing and meandering incapable of being restored occur.

By the way, a circuit shown in FIG. 21 can be used instead of the PLL circuit 261D in the above-described modification illustrated in FIG. 16.

In FIG. 21, a latch pulse forming circuit 261E is constituted by a circuitry having a function like a one-shot multivibrator, which circuitry is composed of a shift register 610E, a clock oscillator 611E, a NOT circuit 612E and a NAND circuit 613E.

The operation of the latch pulse forming circuit 261E is as shown in FIG. 22. That is, the signal $S_{21}$ from the OR gate 261C is inputted to the shift register 610E in synchronism with clock signals CK from the clock oscillator 611E having a cycle considerably short as compared with that of the signal $S_{21}$. A $Q_c$ output at the third step, for example, is inverted into a signal $\overline{Q}_C$ by the NOT circuit 612E. The NAND circuit 613E takes an exclusive "or" of the signal $\overline{Q}_C$ and a $Q_B$ output at the second step of the shift register 610E, to thereby obtain the signal $S_{23}$.

By doing so, there is obtained the signal $S_{23}$ or the latch pulse signal which is synchronized during the High level duration of the signal $S_{21}$, in other words, during the period for which one of the sprocket holes 10A in each of the opposite side edges of the fan-folded form 10 crosses the optical path in a corresponding one of the detectors 31 and 32.

Since the modification shown in FIGS. 21 and 22 obtains the negative pulses, it is necessary to select the latch circuit 261A and the re-triggerable mono-multi 261B which are of respective types latched and triggered in response to the negative edge of each pulse signal. Further, the phase relationship between the signal $S_{23}$ and the signal $S_{21}$ can optionally be set by suitable selection of the $Q_n$ outputs taken out from the shift register 610E.

Additionally, if the right-hand signals $R_{error}$ and the left-hand signals $L_{error}$ are totalized separately from each other by the use of respective counting devices, there are obtained right-hand and left-hand skewing careers or histories. Accordingly, it is possible also to adjust the right-hand and left-hand fixing pressures at the fixing station 8, on the basis of the respective totalized values.

Moreover, as shown in FIG. 24, if the center of the optical path in each of the detectors 31 and 32 is shifted outwardly from the line passing through the centers of the respective sprocket holes 10A in a corresponding one of the opposite side edge portions of the fan-folded form 10, the following advantages can be expected.

The right-hand detector 31 is so positioned that the center of the optical path is brought fully near the right-hand end or the lower end as viewed in FIG. 24, of the sprocket hole 10A provided in the right-hand side edge portion of the fan-folded form 10. On the other hand, the left-hand detector 32 is so positioned that the center of the optical path is brought fully near the left-hand end or the upper end as viewed in FIG. 24, of the sprocket hole 10A provided in the left-hand side edge portion of the fan-folded form 10.

By doing so, even if skewing of the fan-folded form 10 is slight in amount, the left-hand detector 32 can immediately detect the abnormality to issue the signal $L_{error}$ in case of rightward skewing. On the other hand, the right-hand detector 31 can immediately detect the abnormality to issue the signal $R_{error}$ in case of leftward skewing.

By utilizing the signals $L_{error}$ and $R_{error}$, it is made possible to correct skewing of the fan-folded form 10. That is, the back-tension applied to the fan-folded form 10 by a left-hand mechanism section of the direction-regulating feed mechanism 9 increases in response to the signal $L_{error}$, while the back-tension applied to the fan-folded form 10 by a right-hand mechanism section of the direction-regulating feed mechanism 9 increases in response to the signal $R_{error}$, thereby correcting skewing of the fan-folded form 10.

In order to realize the above correcting operation, it is necessary to modify the arrangement in such a manner that the direction-regulating feed mechanism 9 is divided into a pair of right-hand and left-hand mechanism sections which can apply their respective back-tensions to the fan-folded form 10 independently of each other, as shown in FIG. 23.

Specifically, a shaft remote from the fixing station 8 is divided into a pair of right-hand and left-hand shaft sections 92R and 92L. The shaft sections 92R and 92L have their respective inner ends which are rotatably supported by respective bearings 93R and 93L. Outer ends of the respective shaft sections 92R and 92L are drivingly connected respectively to bearings 94R and 94L each having a predetermined rotative resistance, through respective electromagnetic clutches 95R and 95L. Thus, the right-hand and left-hand mechanism sections of the direction-regulating feed mechanism 9 can apply their respective back-tensions to the fan-folded form 10 independently of each other.

The electromagnetic clutches 95R and 95L are controlled in an ON and OFF manner in response to the respective signals $R_{error}$ and $L_{error}$. Thus, it is possible to control the back-tension applied to the fan-folded form 10 by each of the mechanism sections of the direction-regulating feed mechanism 9 so as to increase the back-tension or to return the same to a usual value.

The electromagnetic clutches 95R and 95L are controlled by the signals $R_{error}$ and $L_{error}$ in such a direction that these signals are not outputted. Thus, such control may be considered to form an automatic control system constituting a so-called feedback loop.

Accordingly, if the direction-regulation feed mechanism 9 is modified so as to have the pair of mechanism sections controlled by the signals $R_{error}$ and $L_{error}$ in the manner as described above, it is made possible to automatically correct skewing of the fan-folded form 10.

FIGS. 25 through 28 show still another modification of the invention. In the modification, the direction-regulating feed mechanism 9 has a shaft 93 on the side of the fixing station 8, which shaft is fixedly mounted to the chassis 40. A pair of right-hand and left-hand pulleys 93A and 93A are mounted on the shaft 93 for free rotation relative thereto such that the pulleys 93A are 93A rotate with transportation of the fan-folded form 10. The right-hand and left-hand pulleys 93A and 93A are operatively connected, through respective belts, respectively to rotary encoders 13R and 13L which serve as pulse-signal generating means for generating pulse signals in synchronism with the transport velocity of the fan-folded form 10. Each of the rotary encoders 13R and 13L is so adjusted as to generate the pulse signals in synchronism with the projections 91A on a corresponding one of the right-hand and left-hand tension belts 91 and 91. Thus, the rotary encoders 13R and 13L can generate the pulse signals in synchronism with the transport velocity of the fan-folded form 10, in other words, in synchronism with moving velocity of the sprocket holes 10A in the fan-folded form 10.

The modification illustrated in FIGS. 25 and 26 comprises a drive control system including a traveling-trouble detecting arrangement for the fan-folded form 10. The drive control system is arranged as shown in FIG. 27. Specifically, a traveling-trouble detecting circuit 361 serving as traveling-trouble detecting means has inputted thereto signals $E_1$ and $E_2$ from the respective rotary encoders 13R and 13L, and a Page signal from a reset-signal generating means 362 subsequently to be described. On the basis of the signals $E_1$ and $E_2$ and the Page signal, the traveling-trouble detecting circuit 361 outputs signals Carry and Borrow that are error signals corresponding respectively to lead and lag of phase of the signal $E_1$ from the rotary encoder 13R on the basis of the signal $E_2$ from the rotary encoder 13L, due to traveling abnormalities of the fan-folded form 10, subsequently to be described.

On the basis of these error signals, a control device 360 controls the drive motor 20 so as to interrupt its driving of the fan-folded form 10 to travel, and displays that the traveling abnormalities occur on the right-hand or left-hand side edge of the fan-folded form 10, by the use of a pair of right-hand and left-hand error indicator lamps 363R and 363L.

The Page signal from the reset-signal generating means 362 is outputted each time the fan-folded form 10 is transported by a distance corresponding to one page, that is, by a distance between each pair of adjacent perforations provided in the fan-folded form 10. In other words, the Page signal is prepared for the purpose of controlling printing information per one page of the fan-folded form 10. In the modification, however, the Page signal is utilized as a reset signal for the traveling-trouble detecting circuit 361.

The specific circuit arrangement of the traveling-trouble detecting circuit 361 serving as the traveling-trouble detecting means will next be described with reference to FIG. 28.

Flow of the various signals will first be traced. The pulse signals $E_1$ and $E_2$ from the respective rotary encoders 13R and 13L serve respectively as data input signals to respective D-type flip-flops (hereinafter each referred to simply as "D-F/F") 361A and 361B. In addition, the pulse signals $E_1$ and $E_2$ are also inputted to an OR gate 361C which takes a logical sum of the pulse signals $E_1$ and $E_2$. The OR gate 361C outputs a signal $C_0$ which is inputted to an IN terminal of a mono-multi vibrator (hereinafter referred to simply as "mono-multi") 361D. The mono-multi 361D outputs a signal $C_{31}$ which is inputted, as clock signals, to a clock-input terminal of each of the D-F/Fs 361A and 361B and to one of a pair of input terminals of each of a pair of NOR gates 361E and 361F subsequently to be described.

The signal $C_{31}$ has a pulse duration $T_x$ which is set by resistors R and capacitors C mounted outside of the mono-multi 361D, and which is determined for the reason to be described later.

As shown in FIG. 28, each of the Q output signals $Q_{31}$ and $Q_{32}$ from the respective D-F/Fs 361A and 361B having the data signals and clock signals determined, is inputted to a corresponding one of a pair of inverters 361G and 361H and to a corresponding one of a pair of NAND gates 361I and 361J, and is processed thereby to obtain signals $S_{31}$ and $S_{32}$ from the output terminals of the respective NAND gates 361I and 361J. That is, negatives of the respective signals $Q_{31}$ and $Q_{32}$ are taken respectively by the inverters 361G and 361H. The signal $Q_{31}$ and the negative of the signal $Q_{32}$ are inputted to the NAND gate 361I to thereby obtain the signal $S_{31}$. On the other hand, the signal $Q_{32}$ and the negative of the signal $Q_{31}$ are inputted to the NAND gate 361J to thereby obtain the signal $S_{32}$.

By the above processing of the signals, each of the signals $S_{31}$ and $S_{32}$ is brought to a signal having its property which varies in condition depending upon the phase difference between the respective signals $E_1$ and $E_2$. Thus, each of the signals $S_{31}$ and $S_{32}$ serves as a gate signal for a corresponding one of the NOR gates 361E and 361F a the subsequent step, to be described later in detail with reference to time charts illustrated in FIGS. 29 through 31.

The signals $S_{31}$ and $S_{32}$ are inputted respectively to the remaining other input terminals of the respective NOR gates 361E and 361F, to obtain respectively output signals $S_{up}$ and $S_{down}$. Thus, the signals $S_{up}$ and $S_{down}$ are brought respectively to signals having their respective properties as count output signals of the clock signals $C_{31}$ controlled by the signals $S_{31}$ and $S_{32}$ serving as the gate signals. This will also be described later with reference to the time charts.

The signals $S_{up}$ and $S_{down}$ are then inputted to respective clock input terminals of a pair of counters 361K and 361L at the subsequent step where the pulse numbers of the respective signals $S_{up}$ and $S_{down}$ are counted respectively. The counters 361K and 361L have their respective registers 361M and 361N. When the counted numbers reach their respective setting values set beforehand respectively by the registers 361M and 361N, the signal Carry is outputted from the counter 361K, and the signal Borrow is outputted from the counter 361L.

The signals Carry and Borrow serve respectively as the error signals corresponding respectively to leftward skewing and rightward skewing of the fan-folded form 10 due to the traveling abnormalities thereof, that is, corresponding respectively to lead and lag of phase of the signal $E_1$ on the basis of the signal $E_2$. This will be described later in detail with reference to the time charts.

Since, at this time, the counters 361K and 361L are required to be preset respectively at constant cycles, the Page signal is inputted to LOAD terminals of the respective counters 361K and 361L to preset them each time the fan-folded form 10 is transported by the distance corresponding to a single page.

As described above, the traveling-trouble detecting circuit 361 is composed of the D-F/Fs 361A and 361B, the OR gate 361C, the mono-multi 361D, the NOR gates 361E and 361F, the inverters 361G and 361H, the NAND gates 361I and 361J, the presettable counters 361K and 361L and the registers 361M and 361N for storing a preset data respectively, which are connected in such a manner that the signals $E_1$ and $E_2$ and the Page signal are inputted to the traveling-trouble detecting circuit 361, and the error signals Carry and Borrow are obtained which respectively represent lead and lag of phase of the signal $E_1$ on the basis of the signal $E_2$.

It is considered difficult for the above description to understand the actual operation of the traveling-trouble detecting circuit 361. Accordingly, the operation will be described with reference to the time charts of the various signals $E_1$, $E_2$, $C_0$, $C_{31}$, $Q_{31}$, $Q_{32}$, $S_{31}$, $S_{32}$, $S_{up}$ and $S_{down}$, illustrated in FIGS. 19, 20 and 21.

FIG. 29 shows the time chart of the various signals in the case that the fan-folded form 10 travels normally.

FIG. 30 shows the time chart of the various signals in the case that the signal $E_1$ that is the signal in synchronism with the transport velocity of the right-hand side edge of the fan-folded form 10 advances as compared with the signal $E_2$ that is the signal in synchronism with the transport velocity of the left-hand side edge of the fan-folded form 10, such as the case where the fan-folded form 10 skews leftward, and the like.

FIG. 31 shows the time chart of the various signals in the case that the signal $E_1$ on the right-hand side of the fan-folded form 10 is delayed as compared with the signal $E_2$ on the left-hand side of the fan-folded form 10, such as the case where the fan-folded form 10 skews rightward and the like, opposite to the case illustrated in FIG. 30.

The signals $E_1$ and $E_2$ from the rotary encoders 13R and 13L are in synchronism respectively with the moving velocity of the sprocket holes 10A in the right-hand side edge portion of the fan-folded form 10 and the moving velocity of the sprocket holes 10A in the left-hand side edge portion thereof. Accordingly, the logical sum of these signals $E_1$ and $E_2$ is taken to obtain the signal $C_0$. The mono-multi 361D generates the signal $C_{31}$ of the pulse duration $T_x$ as shown in FIG. 29, at rise (positive edge) of the signal $C_0$.

That is to say, the signal $C_{31}$ is so set that the rise (positive edge) of the signal $C_{31}$ is located in the vicinity of the center of the High level duration in each of the signals $E_1$ and $E_2$, during normal traveling of the fan-folded form 10. By doing so, during normal traveling of the fan-folded form 10, the D-F/Fs 361A and 361B output their respective signals $Q_{31}$ and $Q_{32}$ from the respective Q output terminals, at rise (positive edge) of the clock signal $C_{31}$, with the signals $Q_{31}$ and $Q_{32}$ corresponding respectively to the High level durations of the respective signals $E_1$ and $E_2$.

Accordingly, the signals $S_{31}$ and $S_{32}$ also keep their respective High levels. Therefore, the NOR gates 361E and 361F are closed in their respective gates, so that the output signals $S_{up}$ and $S_{down}$ keep their respective Low levels. Here, however, if the fan-folded form 10 skews rightward or leftward, lead and lag of phase occurs between the signals $E_1$ and $E_2$, as shown in FIGS. 30 or FIG. 31.

In these cases shown respectively in FIGS. 30 and 31, the pulse duration of the signal $C_0$ is lengthened. In addition, the timing of rise (positive edge) of the signal $C_{31}$ formed by operation of the mono-multi 361D at rise (positive edge) of this signal $C_0$ is maintained identical with that for the case shown in FIG. 29 where the fan-folded form 10 travels normally. However, the signals $E_1$ and $E_2$ that are the data input signals to the respective D-F/Fs 361A and 361B operative in response to the signal $C_{31}$ serving as the clock signals are such that the signal $E_2$ is brought to the Low level in the case shown in FIG. 30, while the signal $E_1$ is brought to the Low level in the case shown in FIG. 31. Accordingly, the signal $Q_{32}$ is brought to the Low level from the timing of rise (positive edge) of the signal $C_{31}$ in the case shown in FIG. 30, while the signal $Q_{31}$ is brought to the Low level from the timing of rise (positive edge) of the signal $C_{31}$ in the case shown in FIG. 31. Such changes cause the signals $S_{31}$ and $S_{32}$ to be brought to their respective Low levels for the cases shown respectively in FIGS. 30 and 31, so that the NOR gates 361E and 361F are opened in their respective gates for the cases shown respectively in FIGS. 30 and 31. Thus, the signal $S_{up}$ for the case shown in FIG. 30 and the signal $S_{down}$ for the case shown in FIG. 31 continue to output the signals $C_{31}$ that are the clock signals, during the period for which the phase difference exists between the signals $E_1$ and $E_2$.

The counters 361K and 361L count respectively the signals $S_{up}$ and $S_{down}$ which output respectively clock signals during the period for which the lead or lag of phase exists. When the counted numbers reach the respective setting values set beforehand respectively by the registers 361M and 361N, it is judged that errors occur, and the counters 361K and 361L output their respective signals Carry and Borrow.

The signals Carry and Borrow serve as the signals which represent respectively detections of lead and lag of phase on the basis of either one of the transport velocities of the respective right-hand and left-hand side edges of the fan-folded form 10, in other words, respectively detections of the traveling abnormalities due to rightward skewing and leftward skewing of the fan-folded form 10.

Even if the signals $S_{up}$ and $S_{down}$ are counted up to their respective setting values for many hours, the signals Carry and Borrow at this time have no meaning as the error signals due to the traveling abnormalities of the fan-folded form 10, but merely have the right-hand and left-hand permissible skewing careers or histories of the fan-folded form 10. Accordingly, it is necessary to preset the counters 361K and 361L appropriately at a short cycle. In the modification, the presetting is carried out by the aforesaid Page signal.

In response to the right-hand and left-hand error signals, the control device 360 halts operation of the drive motor 20, making it possible to interrupt transportation of the fan-folded form 10 and printing by the printer. At the same time, the control device 360 turns on the left-hand error indicator lamp 363L when the traveling abnormalities occur due to leftward skewing of the fan-folded form 10, that is, when the signal Carry is outputted. On the other hand, the control device 360 turns on the right-hand error indicator lamp 363R when the traveling abnormalities occur due to rightward skewing of the fan-folded form 10, that is, the signal Borrow is outputted. Thus, it is also possible to do the error display on the basis of judgment of the abnormal traveling state.

FIG. 32 shows still other modification, wherein a line sensor 320 is employed to detect the sprocket holes 10A of the continuous form 10.

The line sensor 320 comprises, as illustrated in FIG. 33, a light projecting portion **320*a* and a light receiving portion 320*b*, and a slit 320*c* is formed between the portions 320*a* and 320*b* for passing the continuous form 10** therethrough.

FIG. 34 illustrates a configuration of the output signal of the line sensor 320 in case the continuous form 10 is at its normal traveling state. In this configuration, the peaks $a_1$ and $b_1$ represent the pair of sprocket holes 10A of both sides of the continuous form 10, and L represents the width of the continuous form 10. The peaks $a_2$ and $b_2$ represent the next detected pair of sprocket holes 10A, and T represents the time required for the form 10 traveling by one pitch of the sprocket holes 10A. The traveling speed of the form 10 can therefore be obtained from the detected time T.

FIG. 35 illustrates a block diagram of the traveling-trouble detecting device for detecting the abnormal states of the traveling of the continuous form 10 based upon the output signal of the line sensor 320.

The output signal of the line sensor 320 is fed to three discriminating units 322, 323 and 324 through a memory 321. The memory 321 functions to accumulate the output signal of the line sensor 320 for a predetermined amount.

At the first discriminating unit 322, it is discriminated whether a skewing of the fan-folded form 10 has occurred for a predetermined period. The skewing of the form 10 is discriminated by judging whether the detected length L is changed. That is, if the skewing occurred, the detected length L becomes longer than the actual width of the form 10. In case it is judged that the skewing has occurred for a predetermined period, the first discriminating unit 322 outputs a first error signal which represents occurrence of skewing.

At the second discriminating unit 323, it is discriminated whether a jamming of the form 10 has occurred. The jamming of the form 10 is discriminated also by the change of the detected length L. That is, if the difference of the detected length L from its normal value exceeds a predetermined amount, it is judged that the jamming has occurred, and the second discriminating unit 323 outputs a second error signal which represents occurrence of jamming.

At the third discriminating unit 324, it is discriminated whether a severing of the form 10 at its perforation has occurred. In case the severing occurred upstream of the line sensor 320, the line sensor 320 continuously outputs high level signal. On the other hand, in case the severing occurred downstream of the line sensor 320, the outputs of the line sensor 320 continuously repeats the same pattern configuration, including the successive low level configuration. If it is judged that the severing occurred, the third discriminating unit 324 outputs the third signal representing occurrence of severing.

As above, in the aforementioned embodiment, skewing, jamming and severing can be detected by monitoring the output of the line sensor 320.

Although in the aforementioned embodiment, the form 10 provided with sprocket holes 10A is employed, the traveling-trouble of a continuous form without sprocket holes can be detected by the detecting device constructed as above except the case the form is severed upstream of the line sensor.

What is claimed is:

1. A printer for printing information onto a continuous form having opposed side edges, said printer comprising side-edge detecting means arranged adjacent at least one of said side edges for detecting each said one side edge of said continuous form, and traveling-trouble detecting means for determining that an abnormality has occurred in movement of said continuous form, said detecting means being operative, when a detecting signal representative of a side edge of said continuous form detected by said side-edge detecting means continues for at least a pre-determined period of time, to output an error signal, wherein said traveling-trouble detecting means comprises clock-signal generating means and counter means for counting clock signals outputted from said clock-signal generating means, wherein the detecting signal outputted from said side-edge detecting means is employed as a clear signal for said counter means, and wherein said counter means outputs said error signal when numbers of said clock signals counted by said counter means reach a preset count value.

2. The printer according to claim 1, wherein said side-edge detecting means is composed of a pair of detectors for detecting the respective opposite side edges of the continuous form to output respective detecting signals, and wherein said counter means clears its count value only when the detecting signals are outputted respectively from both the pair of detectors.

3. A printer for printing information onto a continuous form having sprocket holes provided along each of opposite side edges of the continuous form, which comprises a pair of sprocket-hole detecting means, each of said sprocket-hole detecting means outputting a detecting signal each time the sprocket-hole detecting means successively detects the sprocket holes provided in a corresponding one of opposite side edge portions of the fan-folded form being transported, and traveling-trouble detecting means for judging whether or not the detecting signals from at least one of said sprocket-hole detecting means are outputted at timing in compliance with an interval between each pair of adjacent sprocket holes in at least one of the opposite side edge portions of the continuous form, said traveling-trouble detecting means judging that a traveling abnormality of said continuous form provided with the sprocket holes occurs, when the detecting signals from at least one of said sprocket-hole detecting means are not outputted at the timing in compliance with the interval between each pair of adjacent sprocket holes in at least one of the opposite side edge portions of the continuous form, to generate an error signal for at least one of the opposite side edges of the continuous form.

4. The printer according to claim 3, wherein said traveling-trouble detecting means comprises clock-signal generating means for producing clock signals in compliance with the interval between each pair of adjacent sprocket holes provided in at least one of the opposite side edge portions of the continuous form, on the basis of the detecting signals from at least one of said sprocket-hole detecting means, latch means for latching the detecting signals outputted respectively from said pair of sprocket-hole detecting means each time the clock signals are outputted successively from said clock-signal generating means, and a re-triggerable multivibrator successively re-triggered in response to said clock signals, wherein when the detecting signals representative of the sprocket holes in either one of the opposite side edge portions of the continuous form are not outputted from a corresponding one of said pair of sprocket-hole detecting means at latching by said latch means, said latch means outputs the error signal for a corresponding one of the opposite side edges of the continuous form, and wherein a reset signal is outputted from said multivibrator to said latch means when the detecting signals representative of the sprocket holes in both side edge portions of the continuous form are not outputted from the respective sprocket-hole detecting means over a predetermined period of time so that said clock signals are ceased, to cause said latch means to output a pair of error signals respectively representative of the opposite side edges of the continuous form.

5. The printer according to claim 4, wherein said clock-signal generating means is composed of a PLL circuit which produces said clock signal each time when central area of each sprocket hole passes through a certain point on one of said pair of sprocket-hole detecting means.

6. The printer according to claim 5, wherein said predetermined period of time is determined by capacitors and resistors mounted outside of said multivibrator.

7. The printer according to claim 6, wherein each of said pair of sprocket-hole detecting means is composed of a photo-interrupter having a light source and a light-receiving element arranged in facing relation to each other, said light source and said light-receiving element of each of said sprocket-hole detecting means being located respectively above and below a portion of the continuous form extending adjacent and along a corresponding one of the opposite side edges thereof.

8. The printer according to claim 7, wherein the photo-interrupters of the respective sprocket-hole detecting means are positioned in such a manner that an optical path in each of the photo-interrupters is brought near an end of each of the sprocket holes in a corresponding one of the opposite side edge portions of the continuous form, the end of the sprocket hole being remote from the side edge of the corresponding side edge portion.

9. The printer according to claim 4, wherein said clock-signal generating mean comprises a shift register for producing and outputting a pair of signals shifted from each other by a predetermined timing on the basis of said detecting signals from the respective sprocket-hole detecting means, and wherein a phase difference between said pair of output signals from said shift register is utilized to produce said clock signals.

10. A printer for printing information onto a continuous form having opposed side edges, said printer comprising first and second signal generating means for continuously generating respective pulse signals in synchronism with transport velocities of respective opposite side edges of said continuous form, and traveling-trouble detecting means for determining that an abnormality has occurred in movement of said continuous form when one of lead and lag of phase of the pulse signals from one of said first and second signal-generating means in relation to the pulse signals from the other signal-generating means continues for at least a predetermined period of time, to produce an error signal after expiration of a set period of time within a pulse duration of each of the pulse signals from said first and second signal generating means, from the rise of the first one of either of the pulse signals from said first signal generating means and the pulse signals from said second pulse generating means, in a period of time within the pulse duration, to produce a pair of error signals representative of respective lead and lag of phase of the pulse signals from said one signal generating means in relation to the pulse signals from said other signal generating means.

11. The printer according to claim 10, wherein said traveling-trouble detecting means comprises:

clock-signal generating means for producing and outputting clock signals over a predetermined period of time when the pulse signals are outputted from at least one of said first and second signal generating means;

signal detecting means for detecting presence and absence of outputting of the pulse signals from each of said first and second signal generating means at negative edge of said clock signals;

judging means for judging on which side edge of the continuous form absence of the pulse signals is detected, when absence of the pulse signals on either side edge of the continuous form is detected by said signal detecting means; and error-signal output means, when the absence of the pulse signals on the side edge of the continuous form judged by said judging means continues for a predetermined period of time, for outputting the error signal on the side edge of the continuous form.

12. The printer according to claim 11, wherein said clock-signal generating means is composed of a re-triggerable multivibrator which is re-triggered by the pulse signals from at least one of said first and second signal generating means.

13. The printer according to claim 12, wherein said predetermined period of time, by which said clock signals are outputted from said clock-signal generating means, is determined by resistors and capacitors mounted outside of said multivibrator.

14. The printer according to claim 11, wherein said signal detecting means is composed of a pair of flip-flop circuits each having a data input terminal to which said pulse signals are inputted from a corresponding one of said first and second signal generating means.

15. The printer according to claim 14, wherein said judging means comprises a pair of NAND circuits each having a pair of input terminal, and a pair of NOR gates each having a pair of input terminals, the arrangement being such that an output signal from one of said pair of flip-flop circuits is inputted to one of the pair of input terminals of one of said pair of NAND circuits, an inverted signal of the output signal from the one flip-flop circuit is inputted to one of the pair of input terminals of the other NAND circuit, an output from the other flip-flop circuit is inputted to the other input terminal of the other NAND circuit, and an inverted signal of the output signal from the other flip-flop circuit is inputted to the other input terminal of the one NAND circuit, and the arrangement being such that an output from the one NAND circuit is inputted to one of the pair of input terminals of one of said pair of NOR gates, an output from the other NAND circuit is inputted to one of the pair of input terminals of the other NOR gate, and the clock signals are inputted to the other input terminals of the respective one and other NOR gates.

16. The printer according to claim 18, wherein said error-signal output means is composed of a pair of counters each for counting output signals from a corresponding one of said NOR gates to output a corresponding one of said error signals when numbers counted by the counter reach a predetermined count value.

17. The printer according to claim 16, further comprising means for outputting a page signal in response to completion of printing per one page of the continuous form, said page signal being used as reset signals for the respective counters.

18. A printer for printing information onto a continuous form being transported, said printer comprising a line sensor arranged to cross over the width of said continuous form and sensing means along substantially the entire portion that crosses over said continuous form, for detecting opposite side edges of said continuous form, and traveling-trouble detecting means for determining that an abnormality in movement of said continuous form has occurred, based upon a detecting signal indicating the side edges of said continuous form detecting by said line sensor, wherein said traveling-trouble detecting means comprises discriminating means for determining whether skewing has occurred by monitoring the distance between said side edges detected by said line sensor, said discriminating means outputting an error signal when the detected distance differs from a normal value for at least a predetermined period of time.

19. A printer for printing information onto a transportable continuous form, said printer comprising a line sensor arranged to cross over the width of said continuous form and having sensing means, along substantially the entire portion that crosses over said continuous form, for detecting opposite side edges of said continuous form, and traveling-trouble detecting means for determining that abnormality in transporting said continuous form has occurred, based upon a detecting signal representative of the side edges of said continuous form detected by said line sensor, wherein said traveling-trouble detecting means comprises discriminating means for determining whether jamming has occurred by monitoring the distance between said side edges detected by said line sensor, said discriminating means outputting an error signal when the detected distance exceeds a predetermined value.

20. A printer for printing information onto a continuous form having sprocket holes provided along each of opposite side edges of the continuous form, which comprises a line sensor arranged to cross over said continuous form being transported, for detecting the sprocket holds and opposite side edges of said continuous form, and traveling-trouble detecting means for judging that a traveling abnormality of said continuous form provided therein with the sprocket holes occurs based upon a detecting signal representative of the sprocket holes and the side edges detected by said line sensor, said traveling-trouble detecting means comprising:

first discriminating means for judging occurrence of skewing by monitoring the distance between said side edges detected by said line sensor, said first discriminating means outputting a first error signal in case the detected distance differs from a normal value for a preset period of time and more;

second discriminating means for judging occurrence of jamming by monitoring the distance between said side edges detected by said line sensor, said second discriminating means outputting a second error signal in case the detected distance exceeds a predetermined value; and third discriminating means for judging occurrence of severing of said continuous form by monitoring a configuration of an output signal of said line sensor, said third discriminating means outputting a third error signal in case said configuration coincides with one of predetermined patterns.

* * * * *

UNITED STATES PATENT AND TRADEMARK OFFICE

CERTIFICATE OF CORRECTION

PATENT NO. : 4,924,266

DATED : May 8, 1990

INVENTOR(S) : Ikuo NEGORO et al.

It is certified that error appears in the above-identified patent and that said Letters Patent is hereby corrected as shown below:

On the Title page, insert inventor's name ---Kiyoshi NEGISHI---.

In the drawings, please insert Figs. 4, 11, 12, 13, 14, 27, 28, and 32 as attached hereto.

At column 4, line 30, change "on" to ---one---.

At column 4, line 64, change "travel" to ---trouble---.

At column 6, line 36, change "upper" to ---lower---.

At column 6, line 38, change "upper" ---lower---.

At column 6, line 41, change "81B and 81A" to ---81A and 81B---.

At column 6, line 42, change "81B and 81A" to ---81A and 81B---.

At column 6, line 46, change "81B and 81A" to ---81A and 81B---.

At column 6, line 57, change "in stead" to ---instead---.

At column 8, line 61, change "61" to ---61A---.

At column 9, line 45, change "present" to ---preset---.

At column 15, line 67, insert ---data input terminals--- after "respective".

At column 22, line 11, change "a" to ---at---.

At column 22, line 59, change "for" to ---from---.

At column 22, line 64, change "19, 20 and 21" to ---29, 30 and 31---.

At column 25, line 42, insert ---where--- after "case".

At column 28, line 20, (claim 15, line 3), change "terminal" to ---terminals---.

UNITED STATES PATENT AND TRADEMARK OFFICE

CERTIFICATE OF CORRECTION

PATENT NO. : 4,924,266

DATED : May 8, 1990

INVENTOR(S) : Ikuo Negoro et al

It is certified that error appears in the above-identified patent and that said Letters Patent is hereby corrected as shown below:

At column 28, line 61, (claim 18, line 11), change "detecting" to ---detected---.

At column 29, line 23, (claim 20, line 6), change "holds" to ---holes---.

Signed and Sealed this

Twenty-seventh Day of April, 1993

*Attest:*

MICHAEL K. KIRK

*Attesting Officer*

*Acting Commissioner of Patents and Trademarks*